US005300168A

United States Patent [19]

Nakao et al.

[11] Patent Number: 5,300,168

[45] Date of Patent: Apr. 5, 1994

[54] APPARATUS AND METHOD FOR FOLDING SHEET-FORM MATERIAL

[75] Inventors: Akira Nakao, Nara; Toyofusa Endo, Takarazuka; Takeshi Ikeda, Tokyo, all of Japan

[73] Assignee: Hitachi Zosen Corporation, Osaka, Japan

[21] Appl. No.: 978,208

[22] Filed: Nov. 19, 1992

[30] Foreign Application Priority Data

Dec. 12, 1991 [JP] Japan ..... 3-327890
Jan. 13, 1992 [JP] Japan ..... 4-003429
Jan. 13, 1992 [JP] Japan ..... 4-003430

[51] Int. Cl.[5] ..... B32B 31/00; B44C 1/22; C23F 1/00

[52] U.S. Cl. ..... 156/204; 156/634; 156/645; 156/661.1; 156/902; 156/211; 156/226; 156/443

[58] Field of Search ..... 156/644, 629, 630, 634, 156/645, 656, 659.1, 661.1, 901, 902, 204, 209, 211, 226, 227, 252, 443, 442.1

[56] References Cited

U.S. PATENT DOCUMENTS 3,508,108 4/1970 Salisbury ..... 156/645 X
5,071,509 12/1991 Kano et al. ..... 156/901 X
5,201,988 4/1993 Matsumoto et al. ..... 156/645 X

*Primary Examiner*—William A. Powell
*Attorney, Agent, or Firm*—Barnes, Kisselle, Raisch, Choate, Whittemore & Hulbert

[57] ABSTRACT

Apparatus for folding a sheet-form material in a zigzag fashion. Lower and upper guide members are provided in opposed relation in a frame. Sheet-form material is placed under tension between the upper and lower guide members. Plural lower up-and-down movable members are arranged at regular intervals on the lower guide member. Plural upper up-and-down movable members are arranged on the upper guide member at regular intervals and at positions alternate with the lower up-and-down movable members. Fold imparting members are arranged respectively at upper ends of lower up-and-down movable members and at lower ends of upper up-and-down movable members. Upper and lower up-and-down movable members are driven to move toward each other, sequentially from one end side of the upper and lower guide members and toward the other end side, to give folds to the sheet-form material.

5 Claims, 26 Drawing Sheets

APPARATUS AND METHOD FOR FOLDING SHEET-FORM MATERIAL

FIELD OF THE INVENTION

The present invention relates to an apparatus for folding sheet-form material for use in manufacturing surface mount-type folded electronic parts or the like.

BACKGROUND OF THE INVENTION

Recently, a small-size, inexpensive L C noise filter has been proposed which is not liable to produce ringing or the like and yet can positively eliminate penetrating noises.

This noise filter is of a folded type and comprises a first insulating sheet having a first conductor of a rectangular toothed edge-like configuration mounted on one side thereof, and a second insulating sheet having a second conductor of a rectangular toothed edge-like configuration mounted on one side thereof, the two insulating sheets being folded and laminated, with the two conductors staggered relative to each other. In the L C noise filter, constructed as above described, the first conductor functions as a coil having a predetermined number of turns, and the second conductor forms a capacitance relative to the first conductor.

For the purpose of fabricating such a noise filter, it may be conceivable to employ, as an apparatus for folding an insulating sheet in a zigzag fashion, one including a pair of patterns having wave-like alternate ridges and furrows formed on their surface which are adapted to enclose the insulating sheet therebetween.

However, when an insulating sheet is placed between a pair of patterns having alternate ridges and furrows formed thereon, portions at the folds of the sheet become fixed earlier than other portions in flat state. Therefore, if the patterns are moved toward each other when the sheet is in such condition, planar portions between adjacent folds become stretched.

In contrast, if the pair of patterns formed with alternate ridges and furrows is moved to hold therebetween the insulating sheet while the sheet remains unstrained, it is difficult to cause respective ridges and furrows of the patterns to be brought into complete contact because of dimensional tolerances of the pattern pair. Therefore, it is impracticable to give precise folds to the insulating sheet.

DISCLOSURE OF THE INVENTION

Accordingly, it is a primary object of the present invention to provide a sheet-form material folding apparatus which can fold an insulating sheet in a zigzag fashion so as to keep the sheet from becoming stretched, and an apparatus for manufacturing surface-mount type folded electronic parts.

In order to accomplish this object, the apparatus for folding a sheet-form material in a zigzag fashion in accordance with the present invention comprises:

a frame, a lower guide member and an upper guide member which are disposed in opposed relation in the frame and between which is placed said sheet-form material, means for holding one end of the sheet-form material placed between said lower and upper guide members, means for pulling the other end of said sheet-form material, a plurality of lower up-and-down movable members arranged at predetermined intervals on said lower guide member, a plurality of upper up-and-down movable members arranged at predetermined intervals and at positions alternate with said lower up-and-down movable members, a first fold imparting member disposed at an upper end portion of each lower up-and-down movable member for giving folds to said sheet-form material, a second fold imparting member disposed at a lower end portion of each upper up-and-down movable member for giving folds to said sheet-form material, means for urging said upper and lower up-and-down movable members in a direction away from each other, and means for moving said upper and lower up-and-down movable members toward each other against biasing force of said urging means, one after another from one end side of said upper and lower guide members and toward the other end side.

According to such arrangement, the upper and lower up-and-down movable members are moved one by one from one end side of the upper and lower guide members and toward the other end side thereof while the sheet-form material is kept under tension by both the holding means and pull means, and then the first and second fold imparting members are moved toward each other, so that folds are imparted to the sheet-form material sequentially from one end side thereof. Therefore, it is possible to give folds more precisely and without deformation being caused to the sheet-form material, in contrast with the case where folds are imparted in one operation.

DESCRIPTION OF THE EMBODIMENTS

Figure 11:
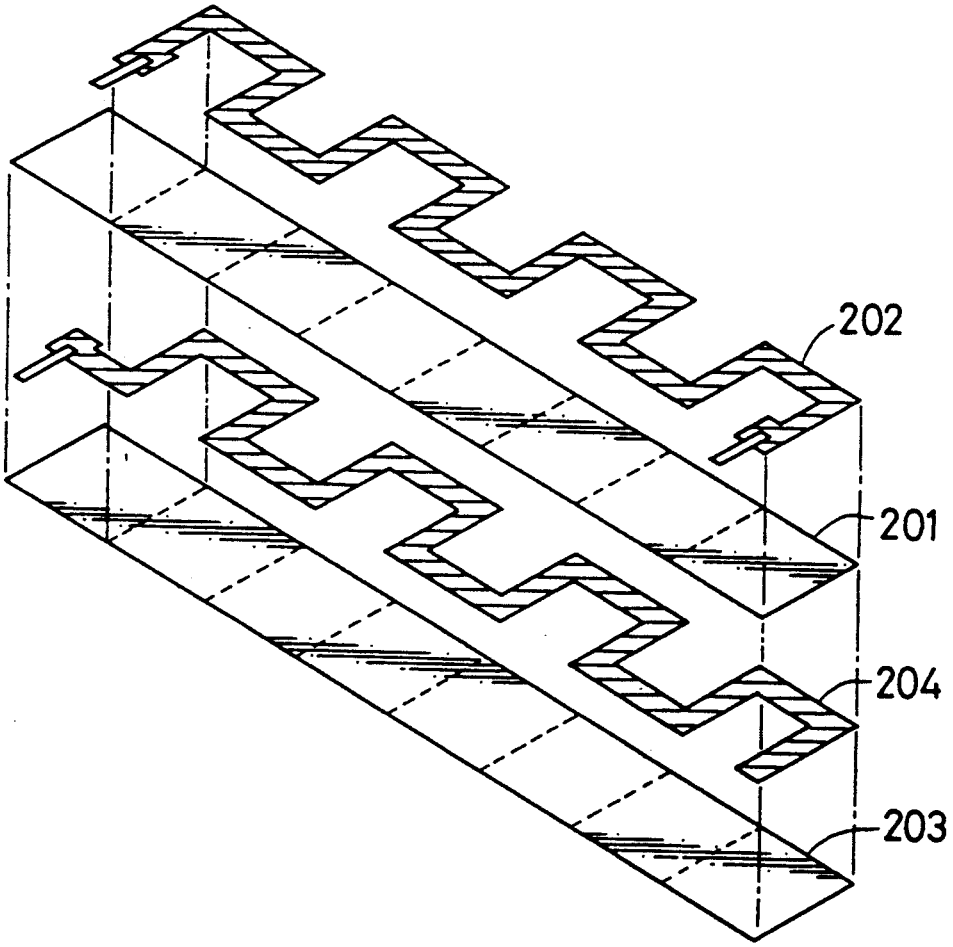
FIG. 11 is an exploded view in perspective showing the construction of sheet-form material.
Figure 12:
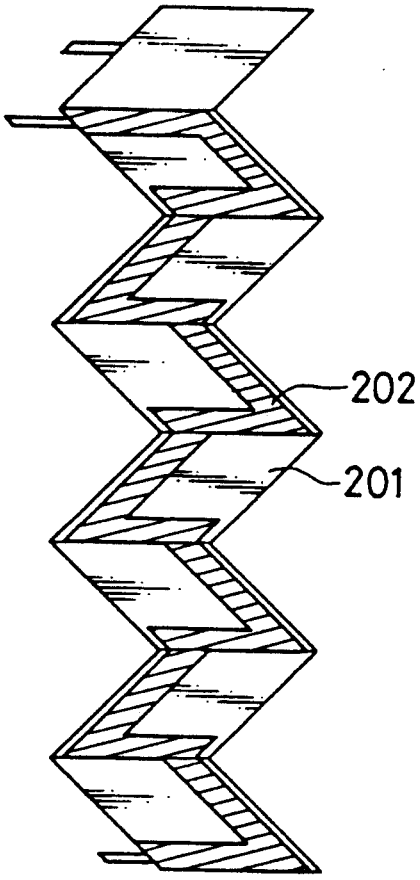
FIG. 12 is a perspective view showing the sheet-form material as folded in zigzag fashion.
Figure 13:
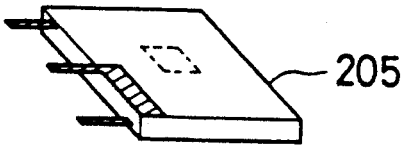
FIG. 13 is a perspective view of a folded surface-mount type electronic part obtained by compacting the sheet-form material.

FIG. 13 shows a folded L C noise filter 205 manufacture by the apparatus for manufacturing folded surface-mount type electronic parts according to the present invention. This noise filter 205, as shown in FIG. 11, comprises a first insulating sheet 201 having a first conductor 202 of a rectangular toothed edge-like configuration mounted on one side thereof, and a second insulating sheet 203 having a second conductor 204 of a similar configuration mounted on one side thereof, the insulating sheets being folded in a zigzag fashion, with the two conductors 202, 204 staggered relative to each other as shown in FIG. 12.

One embodiment of the apparatus for manufacturing folded surface-mount type electronic parts according to the invention will now be described with reference to FIGS. 1 through 8.

The electronic part manufacturing apparatus of the invention is employed in manufacturing an L C noise filter of a predetermined thickness (one example of surface-mount type electronic part) in such a way that a sheet-form material having a rectangular toothed edge-configured conductor applied to one side or both sides thereof is folded in a zigzag fashion and then pressed for compaction.

Broadly, therefore, the electronic part manufacturing apparatus consists of a folding apparatus for folding a sheet-form member in a zigzag fashion, and a compacting unit for pressing the folded sheet-form member to give compaction effect.

These components will be described in detail below.

Figure 1:
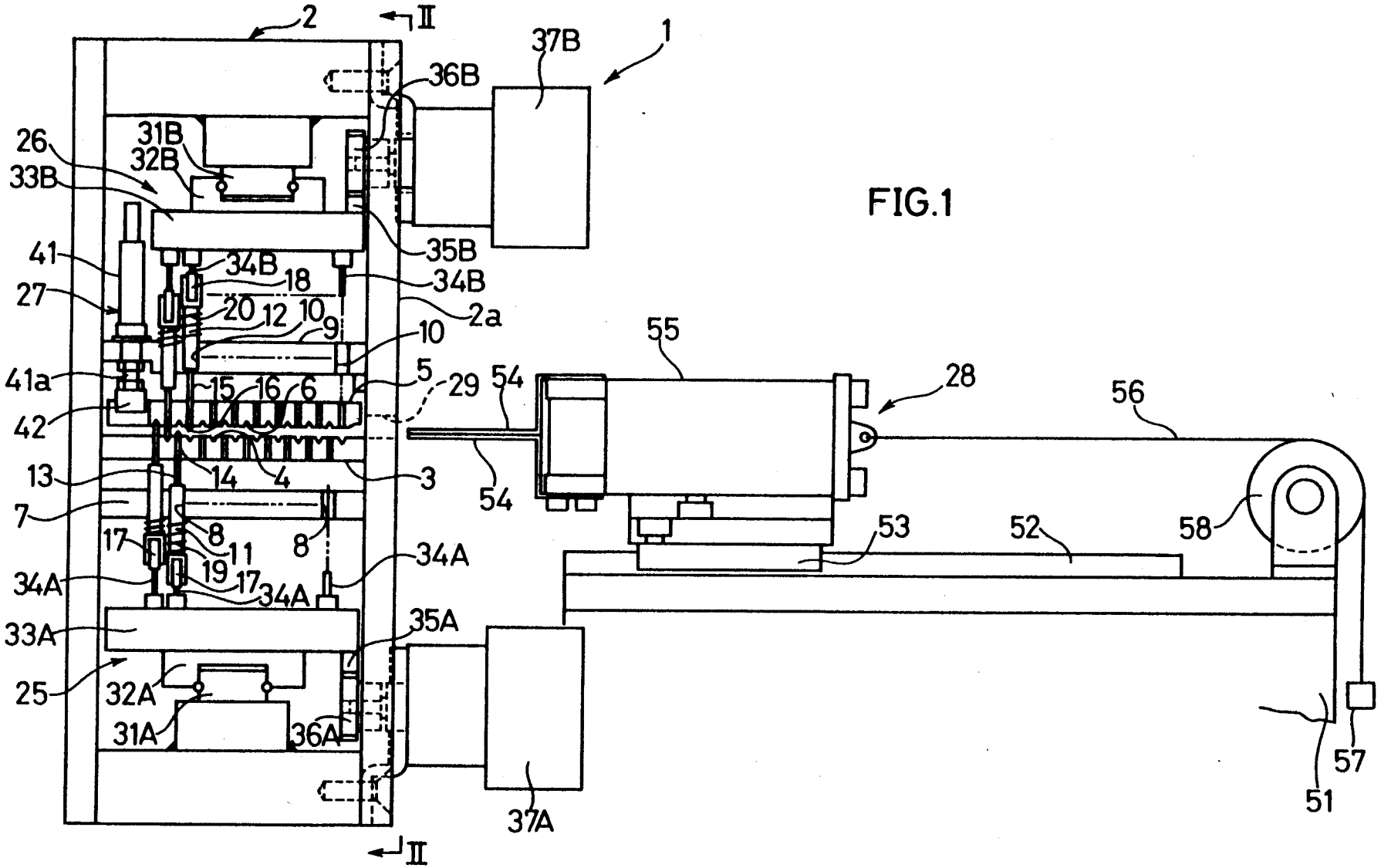
FIG. 1 is a front view of one embodiment representing a sheet-form material folding apparatus according to the present invention.
Figure 2:
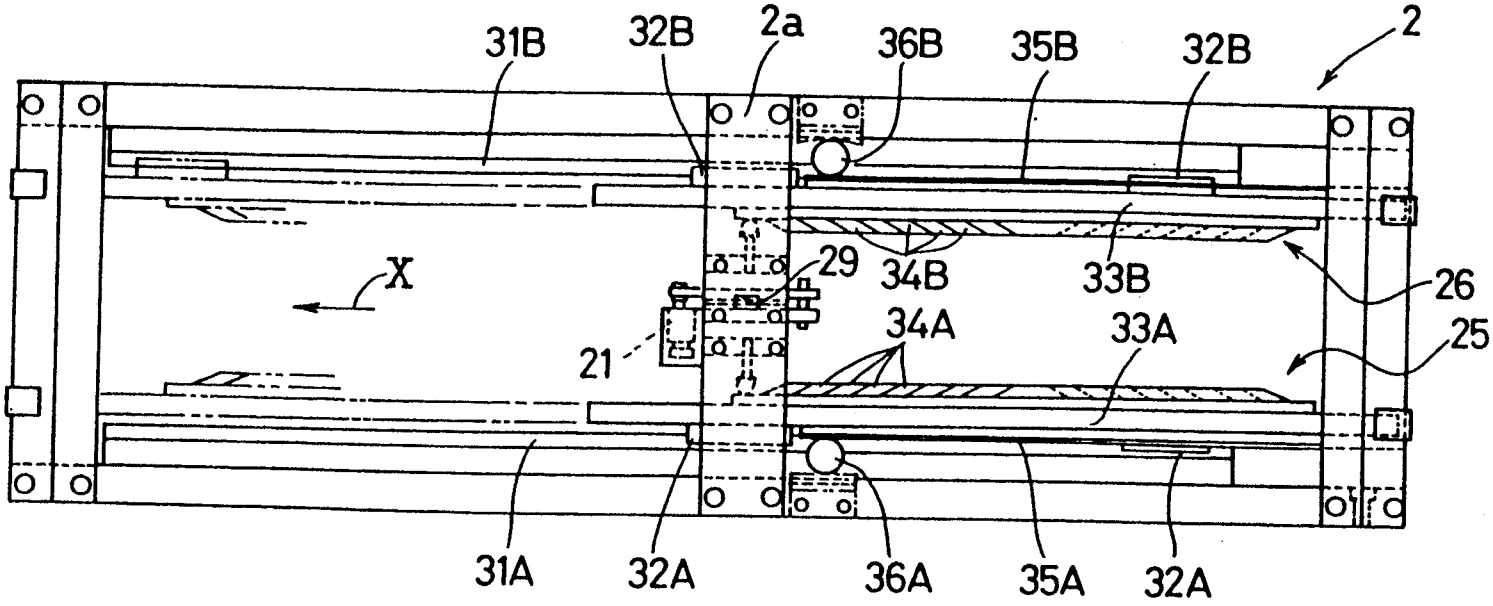
FIG. 2 is a view taken along lines II—II in FIG. 1.
Figure 3:
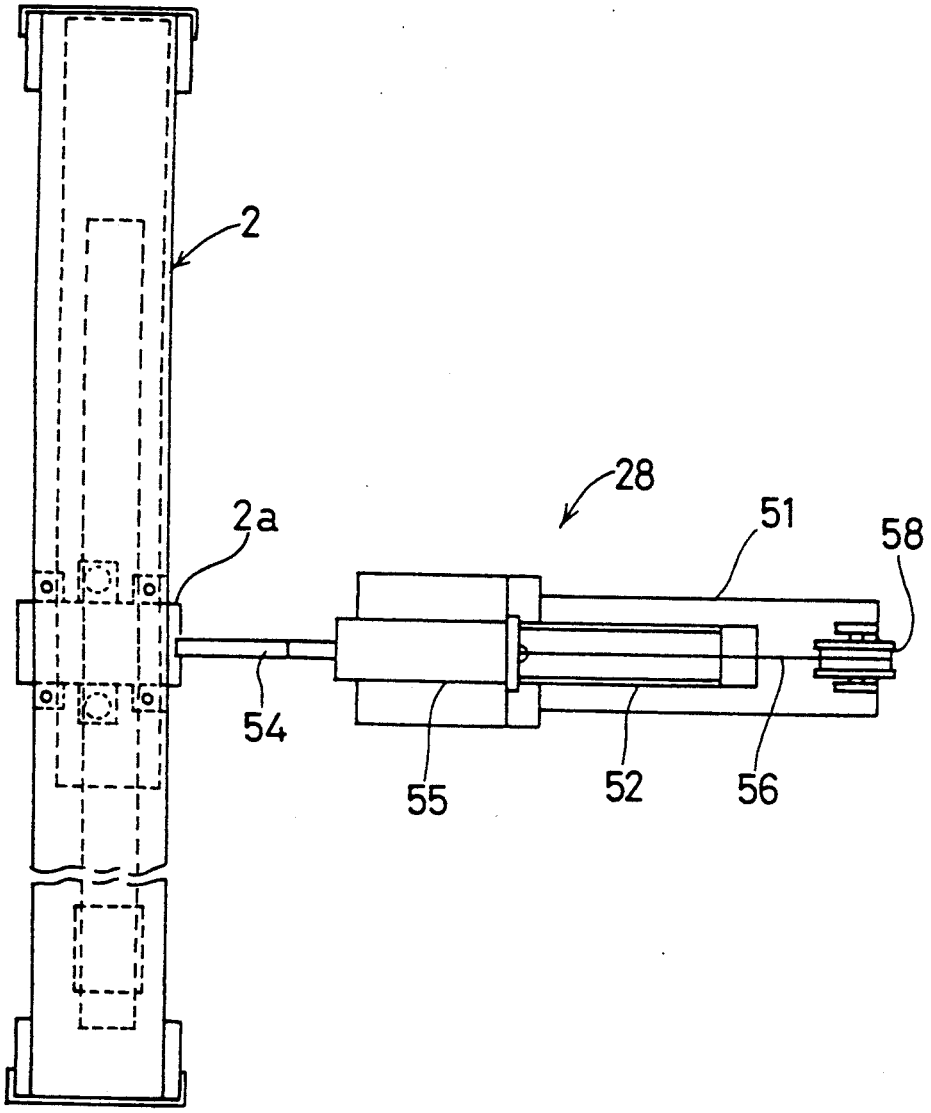
FIG. 3 is a plan view of the folding apparatus in FIG. 1.
Figure 4:
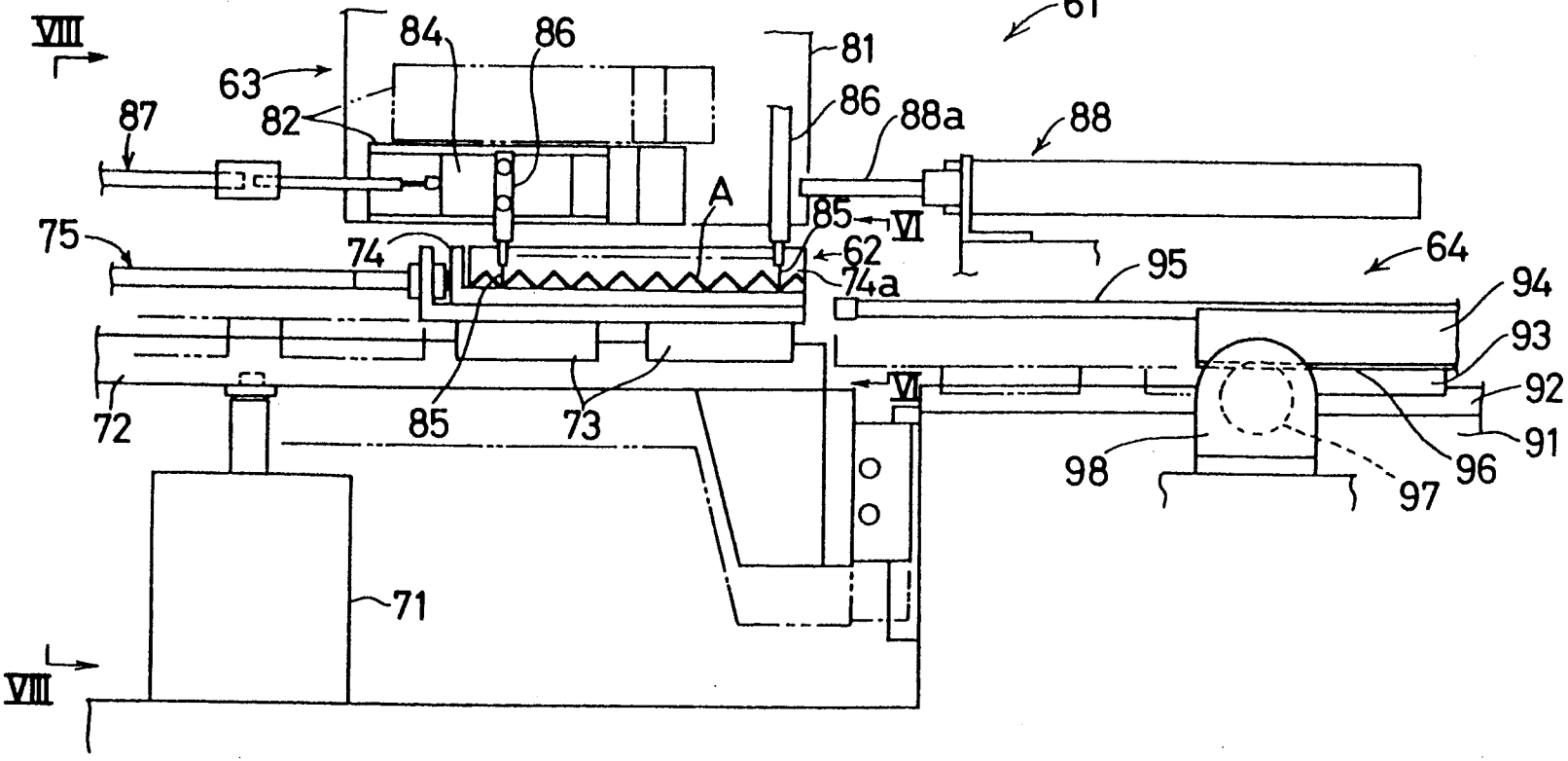
FIG. 4 is a partial front view showing a compacting unit in one embodiment representing an apparatus for manufacturing surface-mount type folded electronic parts according to the invention.
Figure 5:
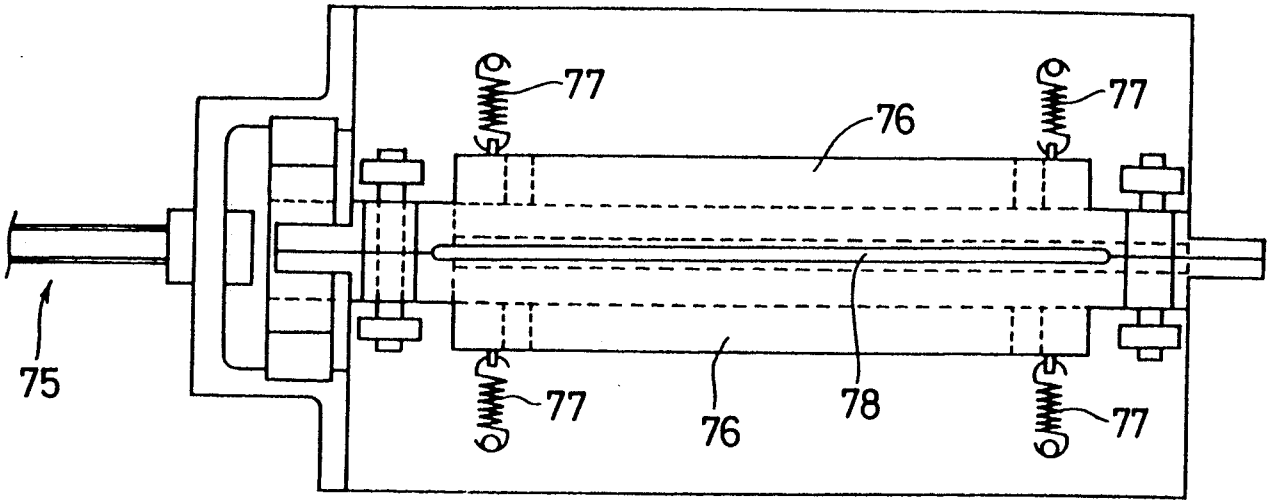
FIG. 5 is a plan view of a storing device in the compacting unit.
Figure 6:
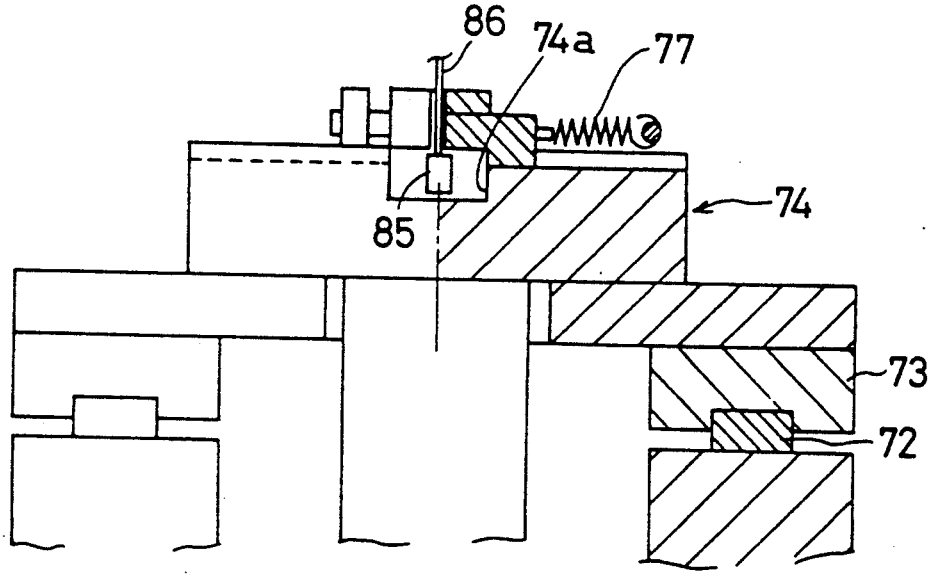
FIG. 6 is a partially cutaway view taken along lines VI—VI in FIG. 4.

As FIGS. 1 to 3 show, the folding apparatus 1 comprises a frame 2 of a rectangular parallelepipedic shape; a lower pattern 3 fixed to a central frame portion 2a of the frame 2 at a predetermined level and having a plurality of triangular grooves 4 formed therein, the lower pattern being of an elongated configuration corresponding to the sheet-form material; an upper pattern 5 up-and-down movably supported by the central frame portion 2a of the frame 2 at a level higher than the lower pattern 3 and having an elongated configuration similar to that of the lower pattern 3; a plurality of triangular grooves 6 formed on the underside of the upper pattern 5 at predetermined intervals and at positions alternate with the grooves 4 of the lower pattern 3; a lower guide member 7 provided on the central frame portion 2a at a position lower than the lower pattern 3 and having through-holes 8 formed at positions corresponding to the grooves 6 of the upper pattern 5; an upper guide member 9 provided on the central frame portion 2a at a position higher than the upper pattern 5 and having through-holes 10 formed at positions corresponding to the grooves 4 of the lower pattern 3; lower up-and-down movable rods 11 vertically movably fitted into the through-holes 8 of the lower guide member 7; upper up-and-down movable rods 12 vertically movably fitted into the through-holes 10 of the upper guide member 9; first fold imparting rods 13 mounted to respective upper ends of the lower up-and-down movable rods 11 and guided by the through-holes formed in the lower pattern 3, with blade edge-shaped fold imparting portions 14 formed at their respective upper ends; second fold imparting rods 15 mounted to respective lower ends of the upper up-and-down movable rods 12 and guided by the through-holes formed in the upper pattern 5, with blade edge-shaped fold imparting portions 16 formed at their respective lower ends; cam followers 17, 18 attached to respective lower ends of the lower up-and-down movable rods 11 and respective upper ends of the upper up-and-down movable rods 12; lower coil springs 19 fitted between respective lower up-and-down movable rods 11 and the lower guide member 7 for biasing the lower up-and-down movable rods 11 downward; upper coil springs 20 fitted between respective upper up-and-down movable rods 12 and the upper guide member 9 for biasing the upper up-and-down movable rods 12 upwards; a cylinder device 21 for the upper pattern which is operative to push the upper pattern 5 downward and upward; lower and upper cam devices 25, 26 operative to elevate and lower the lower up-and-down movable rods 11 and the upper up-and-down movable rods 12 respectively through the cam followers 17, 18 thereby to cause the fold imparting portions 14, 16 to project respectively from the surfaces of the lower pattern 3 and upper pattern 5; a clamping device 27 supported by the upper guide member 9 and operative to hold and release one end of sheet-form material inserted between the lower pattern 3 and the upper pattern 5; and a pull device 28 for pulling under a predetermined force the other end of the sheet-form material held at one end by the clamping device thereby to prevent the sheet-form material from sagging.

On the side of the central frame portion 2a closer to the pull device 28 and at a position between the lower pattern 3 and the upper pattern 5, there is formed an opening 29 for introducing a sheet-form material.

Nextly, cam devices 25, 26 will be described. Since the lower cam device 25 and upper cam device 26 are identical in construction, the description to follow refers to the lower cam device 25 only. Constituent parts of the lower cam device 25 are designated by corresponding numerals with a suffix A, while those of the upper cam device 26 are designated by like numerals with a suffix B and description of same is omitted.

The lower cam device 25 comprises a guide rail 31A mounted to a lower portion of the frame 2 in a direction rectangular to the longitudinal direction of sheet-form material; a movable member 33A movably guided along the guide rail 31A through a slide member 32A; a plurality of cam plates 34A provided on the movable member 33A in corresponding relation to individual cam followers 17; a rack member 35A mounted to the underside of the movable member 33A; a motor 37A mounted to one side of the frame 2; and a pinion 36A mounted to an output shaft of the motor 37A for engagement with teeth of the rack member 35A.

Pluralities of upper and lower cam plates 34A, 34B are arranged in staggered relation, from one end side at which the clamping device 27 is disposed and toward the other end side at which the pull device 28 is disposed, as shown in FIG. 2 so that respective fold imparting portions 14, 16 can project sequentially from the surfaces of the lower pattern 3 and upper pattern 5.

The holding device 27 comprises a cylinder device 41 supported by the upper guide member 9, and a clamping member 42 mounted to the tip of a rod portion 41*a* of the cylinder device 41.

The pull device 28 comprises a support pedestal 51 disposed at a location adjacent the opening 29, a guide rail 52 mounted on the support pedestal 51 and oriented in the longitudinal direction of sheet-form material, or in the direction in which the sheet-form material is folded, a cylinder device 55 movable on the guide rail 52 through a slide member 53, a pair of holding pawls 54 mounted to one end of the cylinder device 55 and adapted to be opened and closed by the cylinder device 55 to hold and release the other end of sheet-form material inserted between the lower pattern 3 and the upper pattern 5; a weight 57 connected to the other end of the cylinder device 55 through a rope member 56 and operative to pull sheet-form material under a predetermined force via the cylinder device 55 and holding pawls 54, and a guide pulley 58 for the rope member 56.

On the basis of the above described arrangement, the manner of operation for folding a sheet-form material will now be explained.

Initially, a sheet-form material is inserted into a space between the lower pattern 3 and the upper pattern 5 through the insertion opening 29 formed through the side of the frame 2, and clamping device 27 is operated to cause clamping member 42 to hold one end of the sheet-form material. Then, the other end of the sheet-form material is held by holding pawl 54 of pull device 28, being subjected to pull under a predetermined force exerted by weight 57.

Nextly, lower and upper cam devices 25, 26 operate to move lower and upper cam plates 34A, 34B in the direction indicated by arrow X in FIG. 2. Then, up-and-down movable rods 11, 12 are caused to move upward and downward, sequentially from the lefthand side in FIG. 1, i.e., from the side at which the sheet-form material is held by clamping device 27, because cam plates 34A, 34B are disposed in staggered relation. Thus, fold imparting portions 14, 16 project one after another to cause the sheet-form material to be pressed at predetermined sites against grooves 6, 4 of the upper pattern 5 and lower pattern 3, so that zigzag folds are imparted to the sheet-form material.

In this way, sheet-form material is pulled under predetermined force and is pressed, sequentially from one end side thereof, against the upper pattern 5 and lower pattern 3, whereby folds are given. Therefore, unlike the case where a plurality of folds are given in one operation, folds can be accurately imparted without undesired deformations being caused to the sheet-form material.

After folds are thus imparted, pull device 28 is released and cam plates 34A, 34B are caused to return to their initial positions, and then upper pattern 5 is elevated by hoisting cylinder device 21, clamping device 27 being then released.

Nextly, the compacting unit which is operative to press the sheet-form material folded by the folding apparatus 1 to thereby give compaction effect will be described with reference to FIGS. 4 through 8.

The compacting unit 61 broadly comprises a storing device 62 for storing sheet-form material A folded in zigzag fashion by the folding apparatus 1, a fold retainer device 63 for retaining folds of the sheet-form material A housed in the storing device 62, and a presser device 64 for pressing one end side portion of the sheet-form material A subjected to fold retention by the fold retainer device 63 toward the other end side portion thereof.

The storing device 62 comprises a guide rail 72 arranged in the direction of sheet-form material A compaction and adapted to be moved upward and downward by an elevating cylinder 71, a storing case 74 movably guided along the guide rail 72 through a slide member 73, a storing recess 74*a* capable of housing sheet-form material A zigzag-folded by the folding apparatus 1, a transport cylinder 75 for moving the storing case 74 in the direction in which compacting force is given to sheet-form material A, a pair of cover members 76 for covering opposite side edges of an open top portion of the storing recess 74*a* of the storing case 74, opening tension springs 77 for biasing the cover members 76 toward an open-oriented direction, and transport means not shown, including a cylinder device, for transporting the cover member 76 in a close-oriented direction against the biasing force of the tension springs 77.

The fold retainer device 63 comprises a support member 81 disposed at a position above the storing case 74, a plurality of guide rails arranged vertically on the support member 81 in parallel to the direction in which sheet-form material A is compacted and in a number equal to the number of folds in the sheet-form material A at fold furrows thereof, a movable member 84 movably guided along each guide rail 82 through a slide member 82, such as a linear bearing, which is much less liable to slide resistance, a compaction guide bar 86 depending from each movable member 84 and having a contact guide plate 85 attached thereto at its lower end, a positioning cylinder device 87 for positioning a corresponding guide bar 86 by moving each movable member 84, and a pressing cylinder device 88 for pressing the guide bar 86 depending from each movable member 84 in the direction in which sheet-form material A is compacted.

The contact guide plate 85 attached to the lower end of each compaction guide rod 86 is of a size that permits its movement within the storing recess 74*a* of the storing case 74. The thickness of the tip of each compaction guide bar 86 for attaching such a guide plate 85 thereto is smaller than the width of a through-groove 78 which is centrally formed in the storing recess 74a when the cover members 76 for the recess 74 are closed. Therefore, even when the cover members 76 are closed, each compaction guide plate 85 can move within the storing recess 74a.

The pressing device 64 comprises a pedestal 91, a guide rail 92 provided on the pedestal 91 at a location corresponding to a lowered position of the storing case 74 and extending in the direction in which sheet-form material A is compacted, a movable member 94 movably guided on the guide rail 92 through a slide member 93, a press rod 95 projecting from the front end of the movable member 94 and toward the storing recess 74a of the storing case 74, a rack member 96 mounted to the underside of the movable member 94, a motor 98 disposed on the pedestal 91, and a pinion 97 engaging the teeth of the rack member 96 and driven by the motor 98.

Nextly, the manner of operating the above described compacting unit 61 for imparting compaction effect to sheet-form material A which has been folded in zigzag fashion by the folding apparatus 1.

Initially, each movable member 84 is actuated by positioning cylinder device 87 to move to a predetermined position, whereupon compaction guide plate 85 is moved to a position according to the pitch of folds in terms of fold furrows corresponding to the predetermined number of turns in a target electronic part.

In parallel with this process, the storing case is lowered and zigzag-folded sheet-form material A is received into the storing recess 74a.

Then, the storing case 74 starts upward movement and, when the lower end of compaction guide plate 85 reaches a position lower than ridges of the folded sheet-form material A, the rod portion of the positioning cylinder device 87 which is operative to position each movable member 84 is retracted so that the movable member 84 is relieved of the action of the cylinder device 87.

Through this process it is possible to avoid such undesirable occurrence that compaction guide plate 85 contacts an oblique side of the folded sheet-form material A in the storing recess 74a due to some configuration error with respect to the folds of the sheet-form material A with the result that some change is caused to the folds. Thus, the lower end of each compaction guide plate 85 can be positioned at a corresponding fold furrow.

Figure 7:
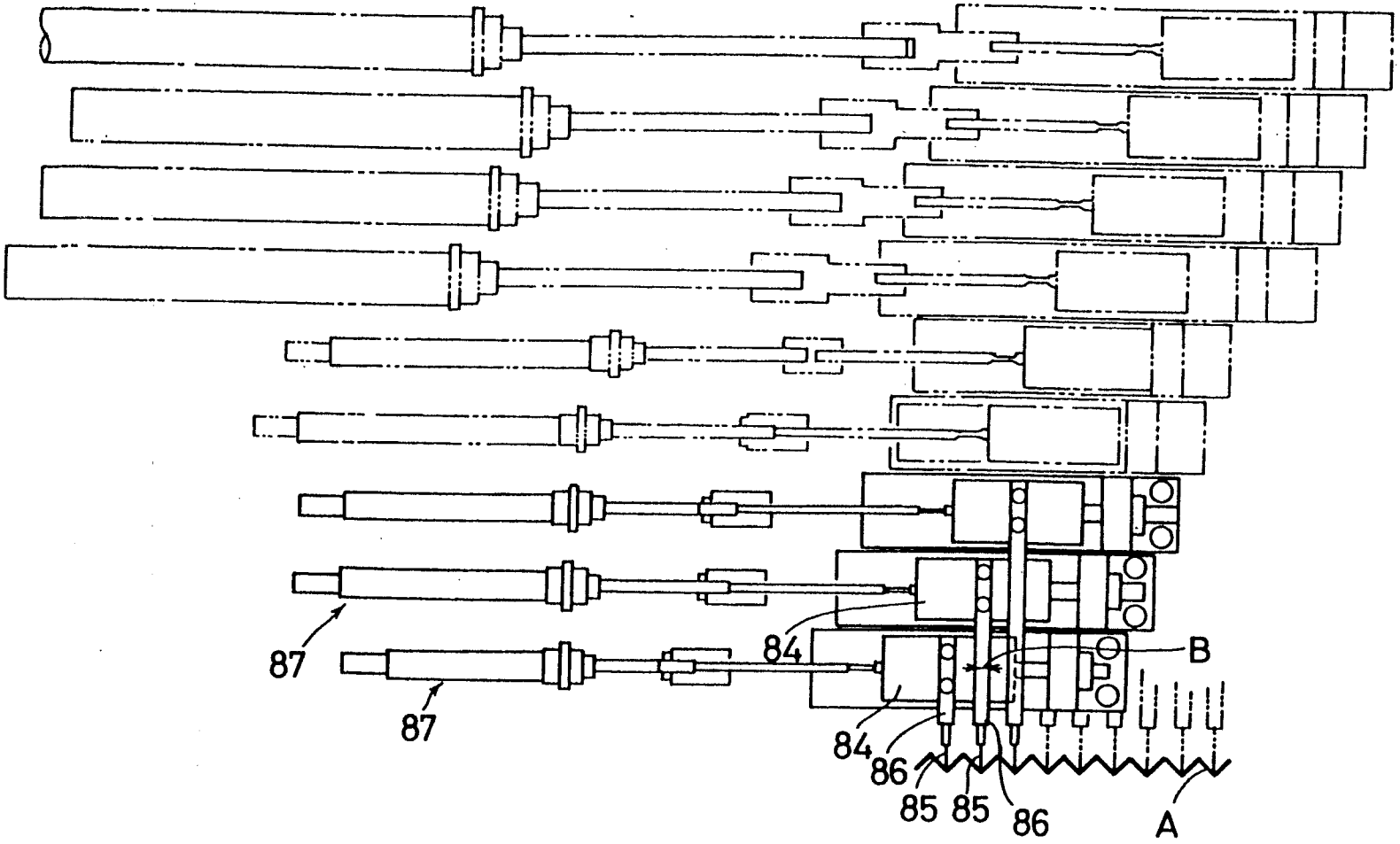
FIG. 7 is a front view showing a fold retainer device in the compacting unit.
Figure 8:
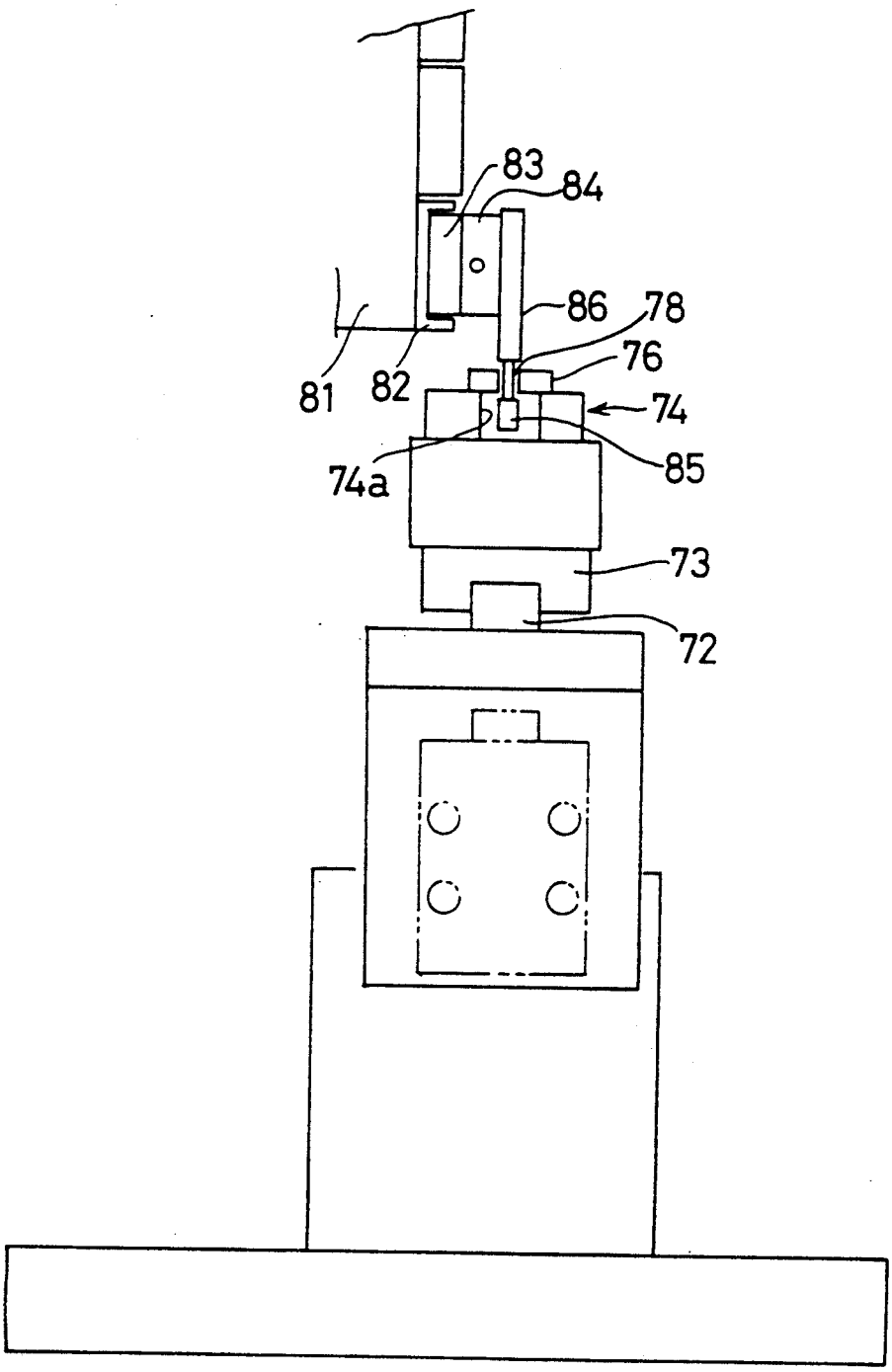
FIG. 8 is a view taken along lines VIII—VIII in FIG. 4.

Subsequently, the cover member 76 is closed and then rod portion 88a of pressing cylinder 88 is extended to push a median portion of one compaction guide rod 86 positioned at one end so as to cause individual compaction guide rods 86 to move close to one another. At this point of time, the inter-furrow pitch of the sheet-form material A is made equal to the width B of each compaction guide rod 86 as shown in FIG. 7.

Then, the cover member 76 is opened and the storing case 74 is lowered, and then the cover member 76 is closed again. The press rod 95 of the pressing device 95 is extended to press the sheet-form material A in the storing recess 74a. As a result, the sheet-form material A is compacted to a final thickness.

Thereafter, the compacted sheet-form material A is removed from the storing recess 74a and then firmly bound therearound by tape or the like.

In this way, a zigzag folded sheet-form material A can be automatically compacted to a predetermined thickness simply by inserting the sheet-form material A into the storing recess 74a of the storing case 74, it being thus possible to easily obtain a surface-mount type electronic part.

Depending upon the characteristics of sheet-form material, there may be cases where compaction guide plate 85 need not be used. In such a case, zigzag folded sheet-form material A is inserted into lowered storing case 74 and cover member 76 is closed, and then the sheet-form material A is compacted by pressing device 64 to a final thickness.

In the folding apparatus 1 of the foregoing embodiment, lower pattern 3 and upper pattern 5, respectively having triangular grooves 4, 6 formed in the surfaces thereof, are used. It is noted, however, that where up-and-down movable rods 11, 12 are accurately guided by guide members 7, 9 so that fold imparting portions 14, 16 are always rightly oriented in relation to sheet-form material A, grooves 4, 6, or upper and lower patterns 3, 5 need not always be provided.

In the folding apparatus 1 of the foregoing embodiment, lower and upper patterns 3, 5 are provided and cam devices 25, 26 are used in moving fold imparting rods 13, 15 upward and downward. Alternatively, as FIGS. 9 and 10 show, instead of employing lower and upper patterns, it may be arranged that fold imparting portions of the fold imparting rods 13, 15 function as upper and lower patterns and are moved upward and downward by cylinder devices.

Figure 9:
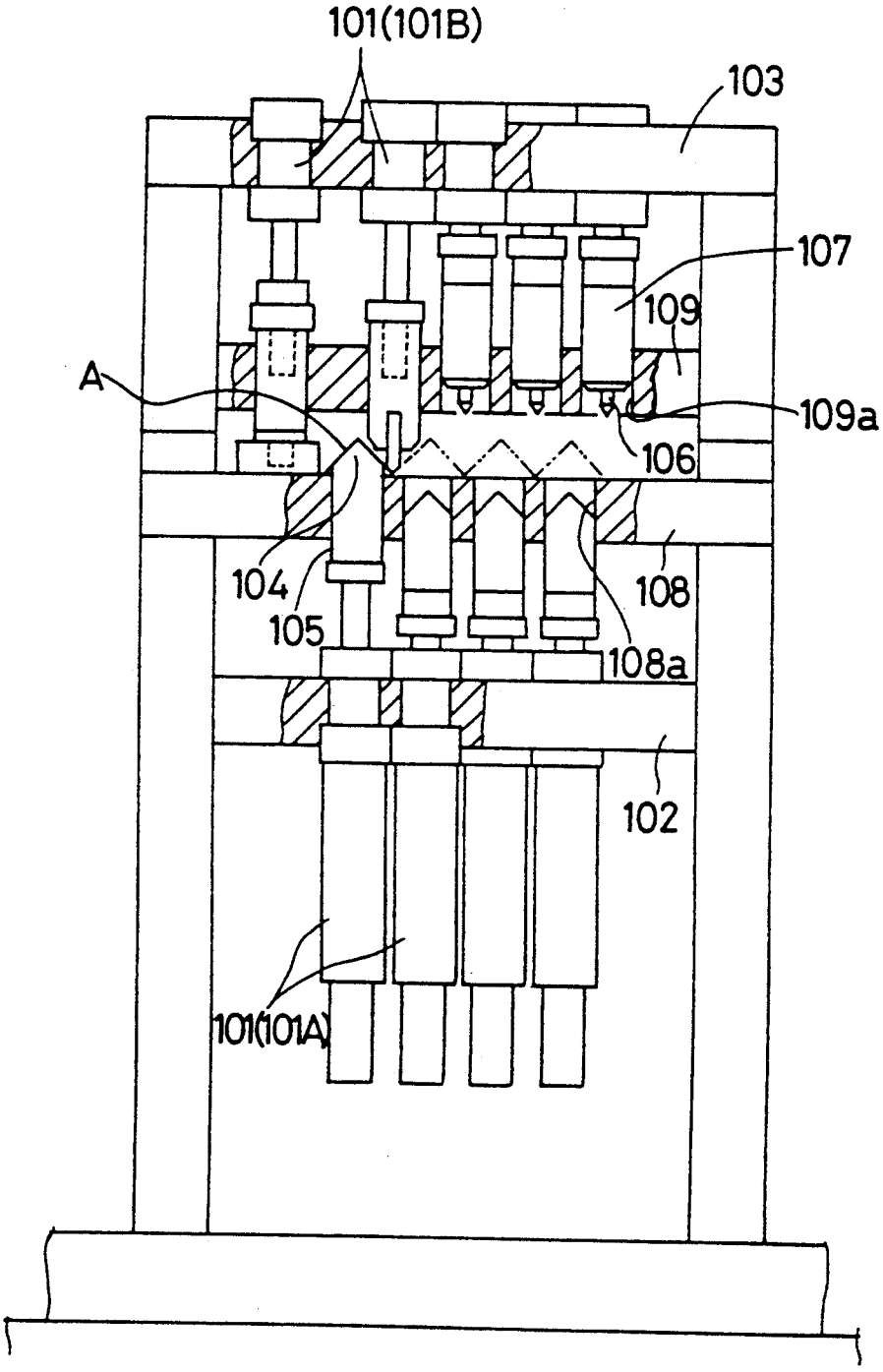
FIG. 9 is a partially cutaway front view of a folding apparatus in another embodiment of the present invention.
Figure 10:
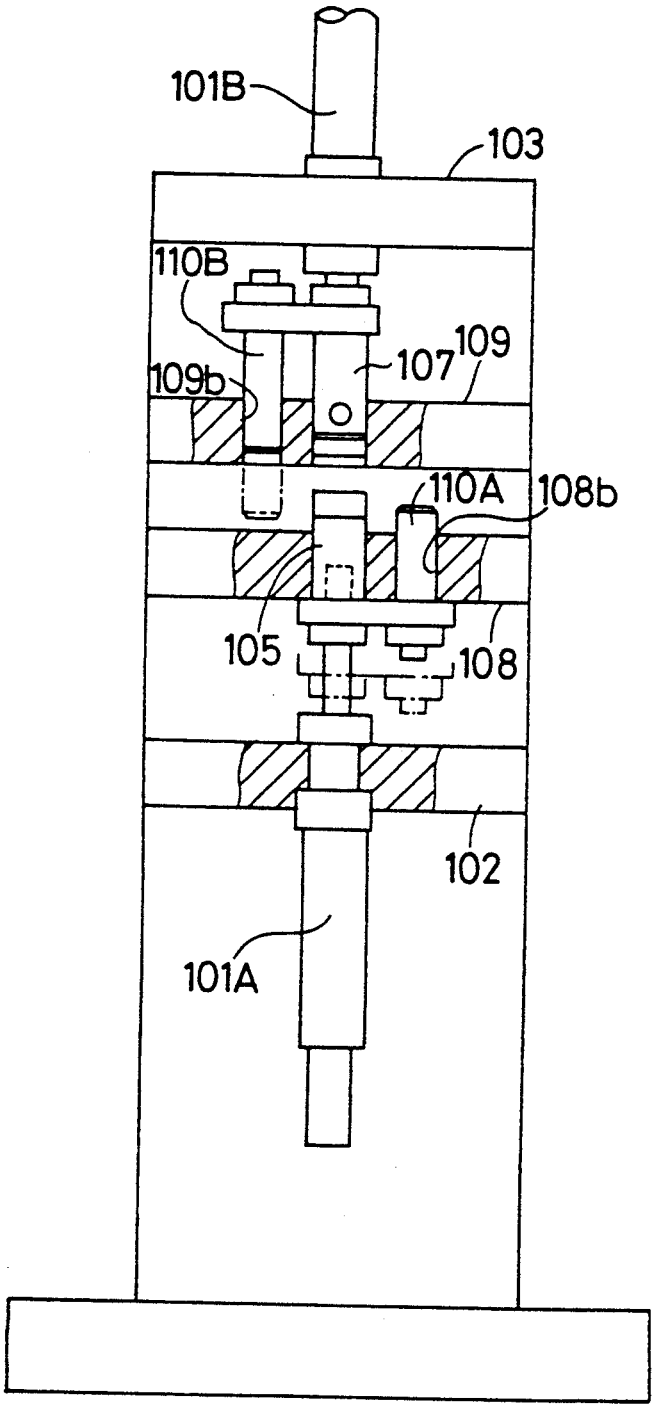
FIG. 10 is a partially cutaway side view of the folding apparatus shown in FIG. 9.

In FIGS. 9 and 10, a plurality of cylinder devices 101 are supported by a lower mount member 102 and an upper mount member 103 respectively at positions corresponding to folds of a folded sheet-form material. At the upper end of the rod of a lower cylinder device 101A there is mounted a first fold imparting rod 105 having a broader triangular fold imparting portion 104 formed thereon, and at the lower end of the rod of an upper cylinder device 101B there is mounted a second fold imparting rod 107 having a narrower triangular fold imparting portion 106 formed thereon. The fold imparting rods 105, 107 are respectively guided by first guide holes 108a, 109a formed respectively in a lower guide member 108 and an upper guide member 109.

In FIG. 10, reference characters 110A, 110B designate guide rods which are attached to fold imparting rods 105, 107 and fitted into second guide holes 108b, 109b formed in the lower guide member 108 and upper guide member 109.

Therefore, in such condition that sheet-form material A is held at one end by clamping device 27 and pulled at the other end by pull device 28, if cylinder devices 101A, 101B are operated sequentially from one end side to cause individual imparting rods 105, 107 to be extended, the sheet-form material A can have folds imparted by respective fold imparting portions 104, 106.

In the arrangement shown in FIGS. 9 and 10, if cylinder device 101 is provided with a guide device, such as a rod-turning stop, second guide holes 108b, 109b and guide rods 110A, 110B may be dispensed with.

Nextly, a method of manufacturing foil-form conductors 202, 204 shown in FIG. 11 will be described.

Figure 14:
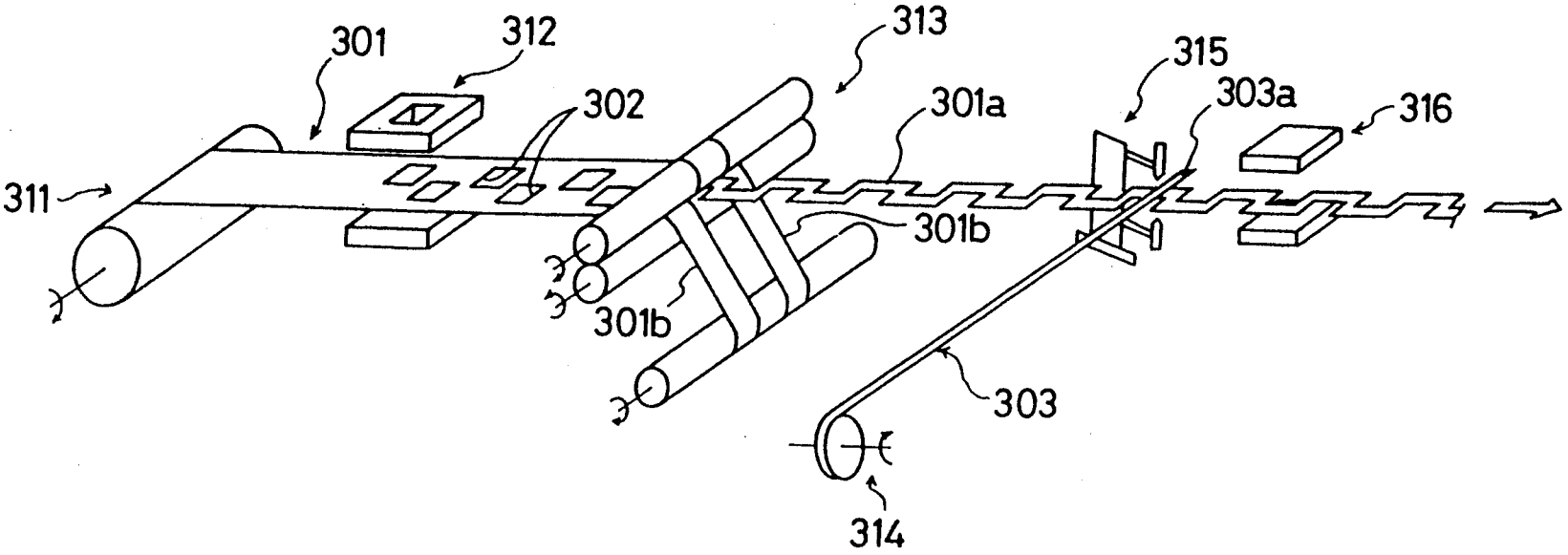
FIG. 14 is a schematic perspective view showing an apparatus for carrying out the method of manufacturing a conductor foil according to an embodiment of the invention.

As shown in FIG. 14, a conductor foil tape 301, such as a copper foil tape, supplied from a conductor foil feed unit 311 is punched by means of a press device 312 to produce rectangular holes 302 in two rows and at a predetermined alternate pitch in zigzag fashion.

Figure 15:
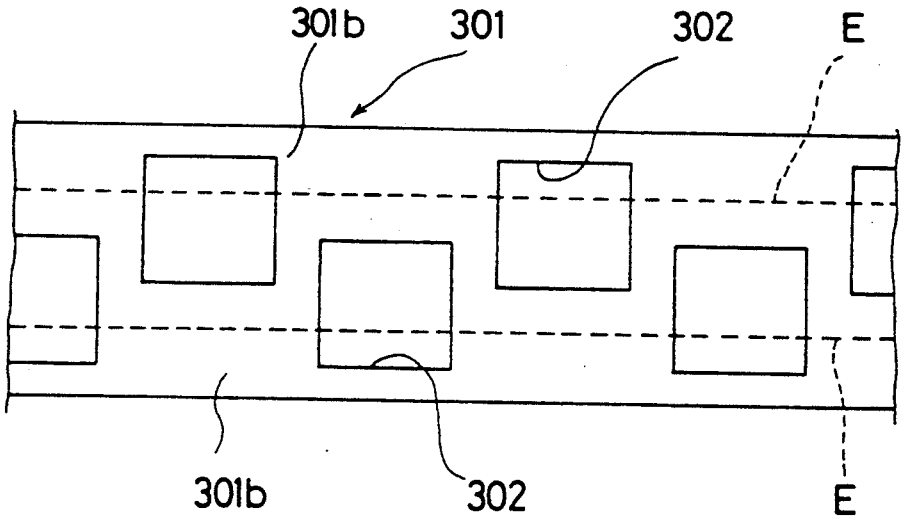
FIG. 15 is a partial plan view of a conductor foil tape shown in FIG. 14.

Then, as shown by broken lines E in FIG. 15, opposite side edge portions 301b of the conductor foil tape 301 are cut off by a conductor foil cutting device (which may be called a slitter) 313 at positions which contain a part of an outer side portion of each row of rectangular holes 302.

Figure 16:
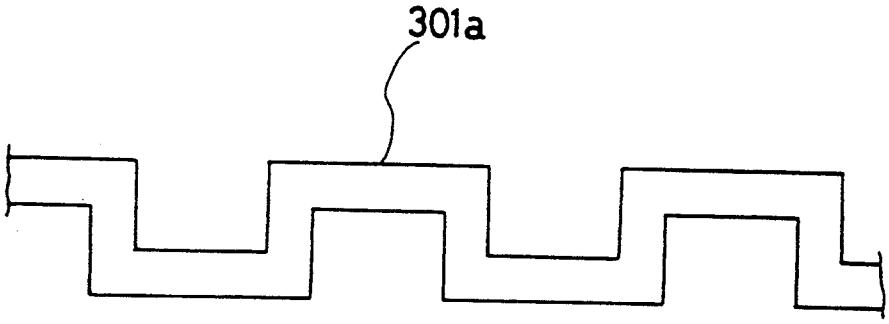
FIG. 16 is a fragmentary plan view of a conductor foil shown in FIG. 14.

As a result, as FIG. 16 shows, the conductor foil tape 301 has a predetermined rectangular toothed-edge configuration. Thus, a conductor foil 301*a* having rectangular teeth formed in a zigzag fashion is obtained.

Figures 17A, 17B, 17C:
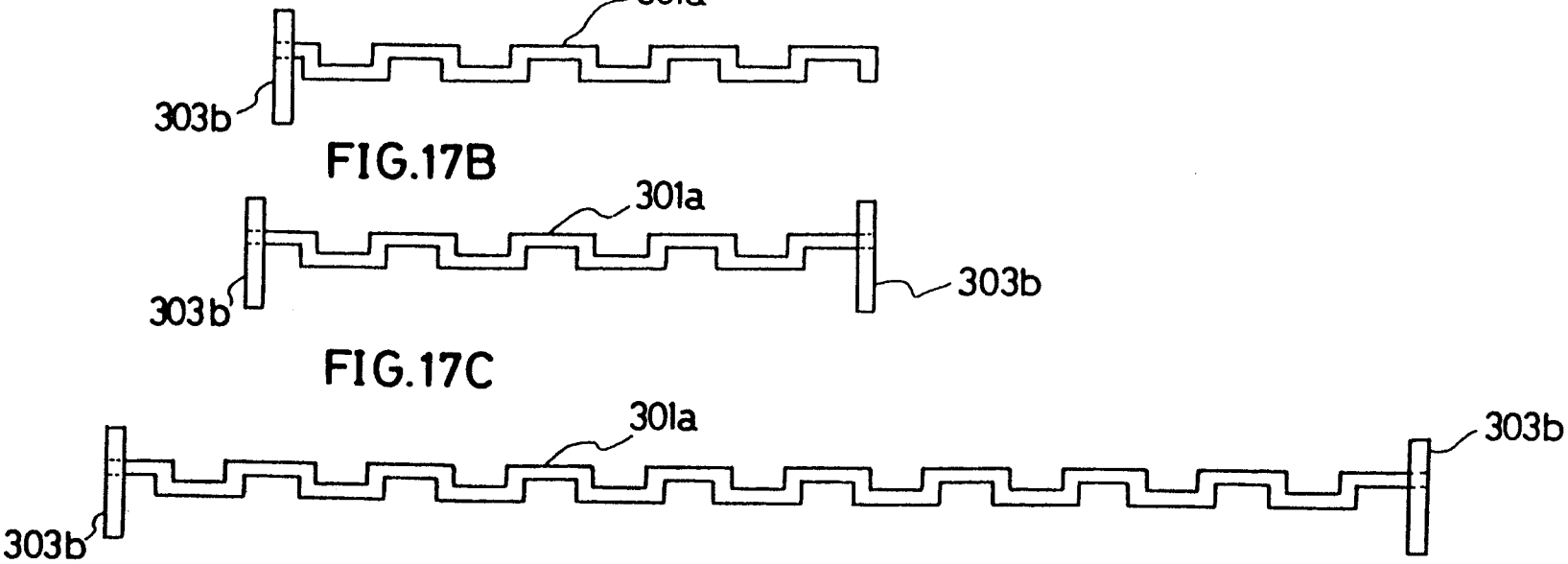
FIGS. 17A to 17C are plan views showing conductor foil patterns by way of example.

On the way along the path of transport of conductor tape 301, a belt-form lead material 303 is supplied from a lead material supply device 314. This lead material 303 is welded as lead material 303*a* by a lead material welding device 315 to conductor foil 301*a* at a predetermined portion thereof. Thereafter, lead material 303*b* is cut by a lead material cutting device 316 and, as FIGS. 17A, 17B, 17C show, desired lead 303*b* is mounted to conductor foil 301*a*. FIG. 17A shows a capacitor conductor, and FIGS. 17B and 17C show inductor conductors.

Nextly, apparatus for manufacture of the above described conductor foil and LC noise filter will be briefly described with reference to the relevant drawings.

This manufacturing apparatus, as stated above, comprises a conductor foil supply device 311; a press device 312 for forming rectangular holes 302 in conductor foil tape 301 supplied from the conductor foil supply device 311; a conductor foil cutting device 313 for cutting opposite side edge portions 301*b* of the conductor foil tape 301 in which rectangular holes 302 have been formed by the press device 312 to form a conductor foil 301*a* of a predetermined pattern; a lead material supply device 314 for supplying lead material tape 303 on the way along the path of transport of conductor foil 301*a* formed by the conductor foil cutting device 313; a lead material welding device 315 arranged on the way along the path of transport of conductor foil 301*a* for welding a predetermined length of lead material 303*a*, supplied from the lead material supply device 314, to the conductor foil 301*a* at a predetermined site thereof; a lead material cutting device 316 for cutting to a predetermined size the lead material 303*a* welded by the lead material welding device 315 to the conductor foil tape 301; and a laminating device (FIG. 25) for laminating an insulating sheet on the conductor foil tape 301 cut by the lead material cutting device 316 to the predetermined size and for cutting the resulting laminate to a predetermined length.

The construction of principal items of the above mentioned component devices will now be described with reference to relevant drawings.

First, description is given with respect to the conductor foil cutting device 313.

Figure 18:
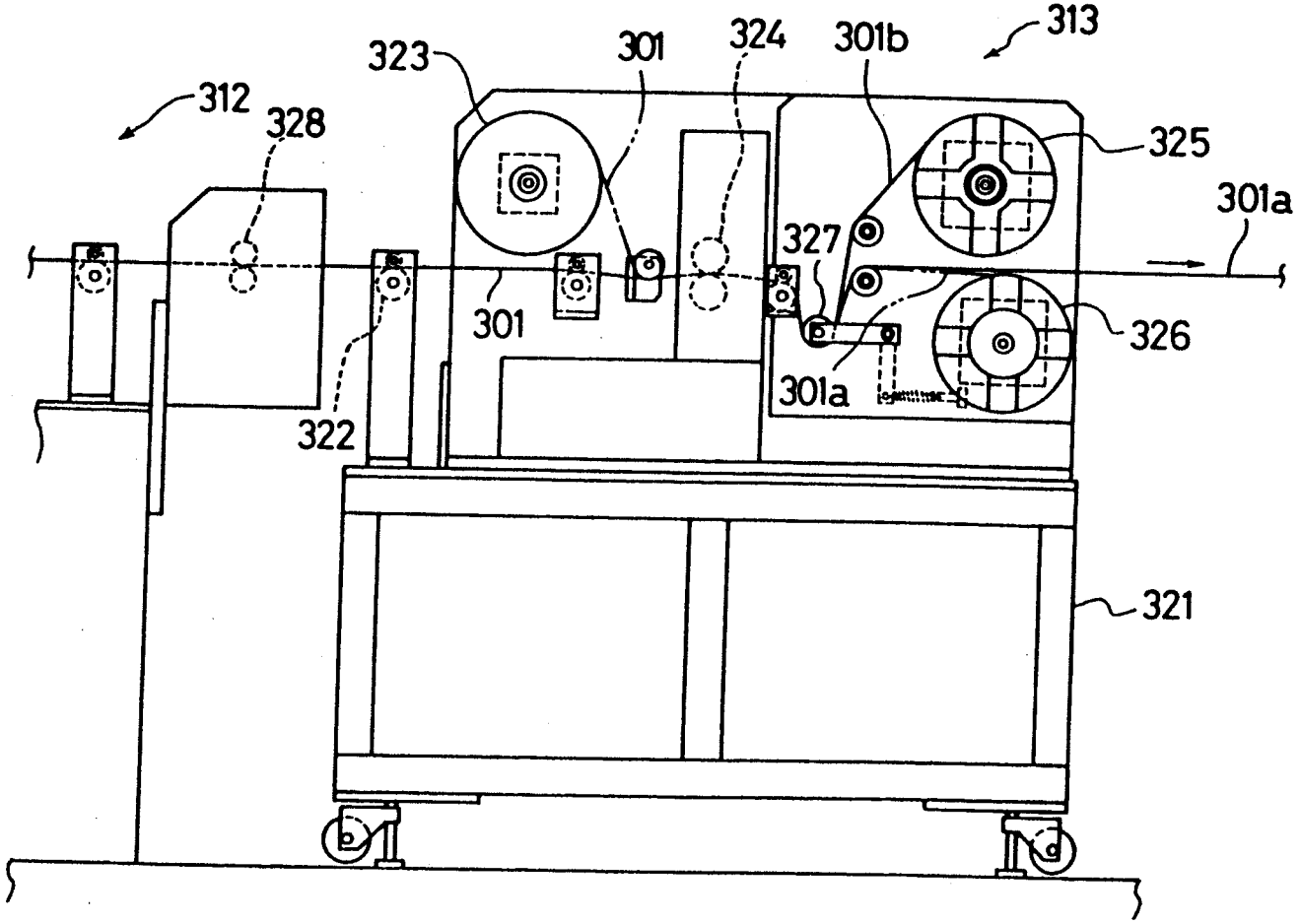
FIG. 18 is a detail side view of a conductor foil cutting device in FIG. 14.

The conductor foil cutting device 313, as FIG. 18 shows, comprises a frame 321; a guide roller 322 disposed at one end of the frame 321 and operative to feed conductor foil tape 301; a reel 323 disposed on the frame 321 at a level above the guide roller 322 and operative to feed conductor tape 301; slitter rollers 324 disposed centrally on the frame 321 for cutting opposite side edge portions 301*b* of conductor foil tape 301 supplied from the press device 312 via the guide roller 322 or, if not supplied directly from the press device 312, supplied from the supply reel 323, while holding same therebetween; a side edge take-up roller 325 disposed on the other end side of the frame 321 for taking up opposite side edge portions 301*b* cut by the slitter rollers 324; a conductor foil take-up roller 326 disposed on the frame 321 at a level lower than the side edge take-up roller 325 for taking up conductor foil 301*a* from which opposite side edge portions 301*b* have been severed; and a tension roller 327 disposed on the frame 321 at a position between the slitter rollers 324 and the take-up rollers 325, 326 for exerting tension to conductor foil 301*a*.

Therefore, conductor foil tape 301, supplied from a roll feeder 328 disposed adjacent the press device 312 after two rows of rectangular holes having been formed therein by the press device 312 in a zigzag fashion, has its opposite side edge portions 301*b* severed by slitter rollers 324 and is thus made into a conductor foil 301*a* of a predetermined pattern. The conductor foil 301*a* is supplied directly to the lead material welding device 315 or taken up by the conductor foil take-up roller 326. Severed side-edge portions 301*b* are wound onto the side edge take-up roller 325.

Nextly, the lead material supply device 314 will be explained.

Figure 19:
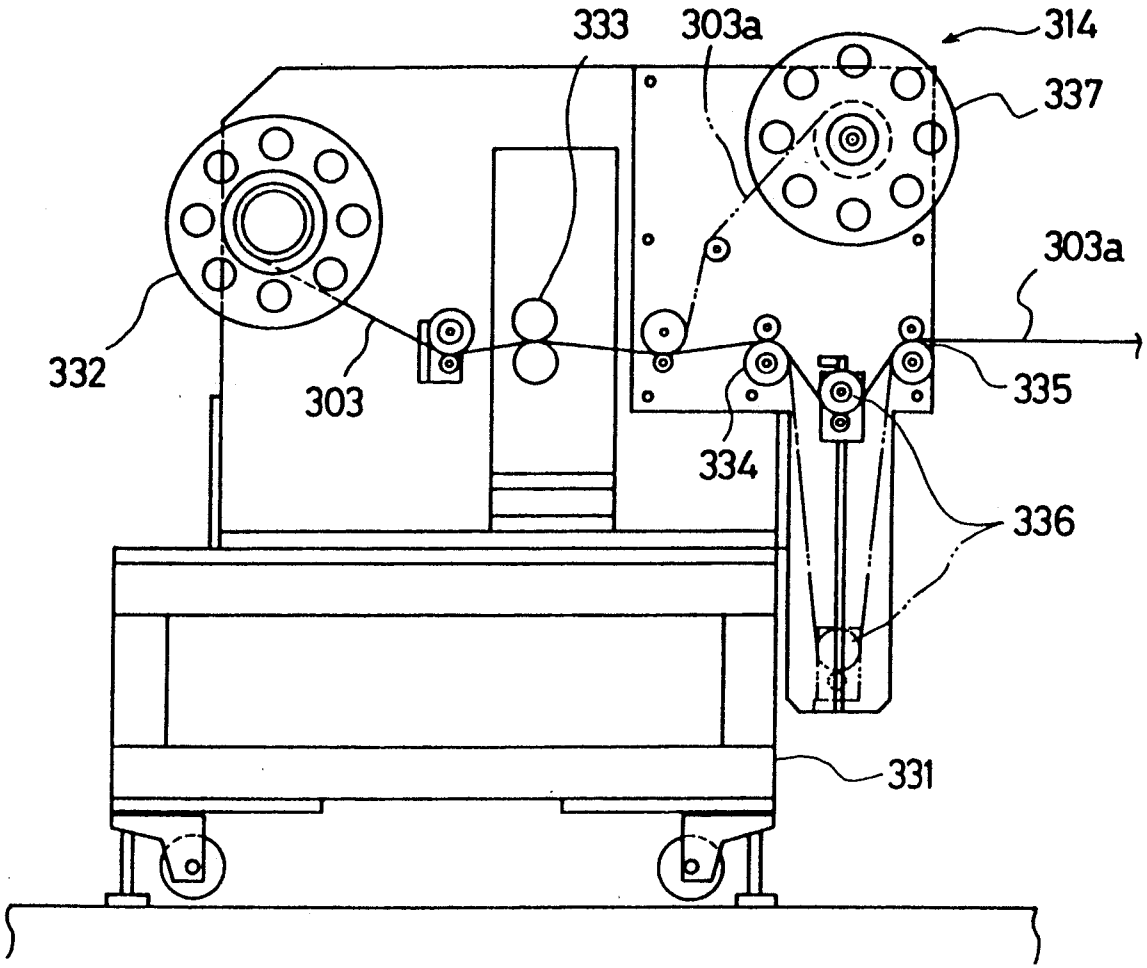
FIG. 19 is a detail side view of a lead material supply device in FIG. 14.

The lead material supply device 314, as shown in FIG. 19, comprises a frame 331; a lead material supply reel 332 disposed at one end side of the frame and having lead material tape 303 wound thereon; slitter rollers 333 disposed centrally of the frame 331 and operative to cut the lead material tape 303 to a predetermined width; front and rear guide rollers 334, 335 disposed at the other end side of the frame 331 for guiding belt-form lead material 303*a*, slit by the slitter rollers 333, to that other end side; supply velocity regulating rollers (which may be called dancer rollers) 336 disposed between the two guide rollers 334, 335; and a lead material winding reel 337 disposed on the other end side of the frame 331 at an elevated position. Where lead material tape 30 has previously been prepared in the predetermined width, the slitter rollers 333 are not required.

Lead material tape 303, such as copper foil tape, is cut to a predetermined width by the lead material supply device 314 to be made into lead material 303*a*, which in turn is supplied directly to the lead material welding device 315. If not supplied directly, the lead material 303*a* is tentatively wound onto the lead material winding reel 337.

Nextly, the lead material welding device 315 will be described.

Figure 20:
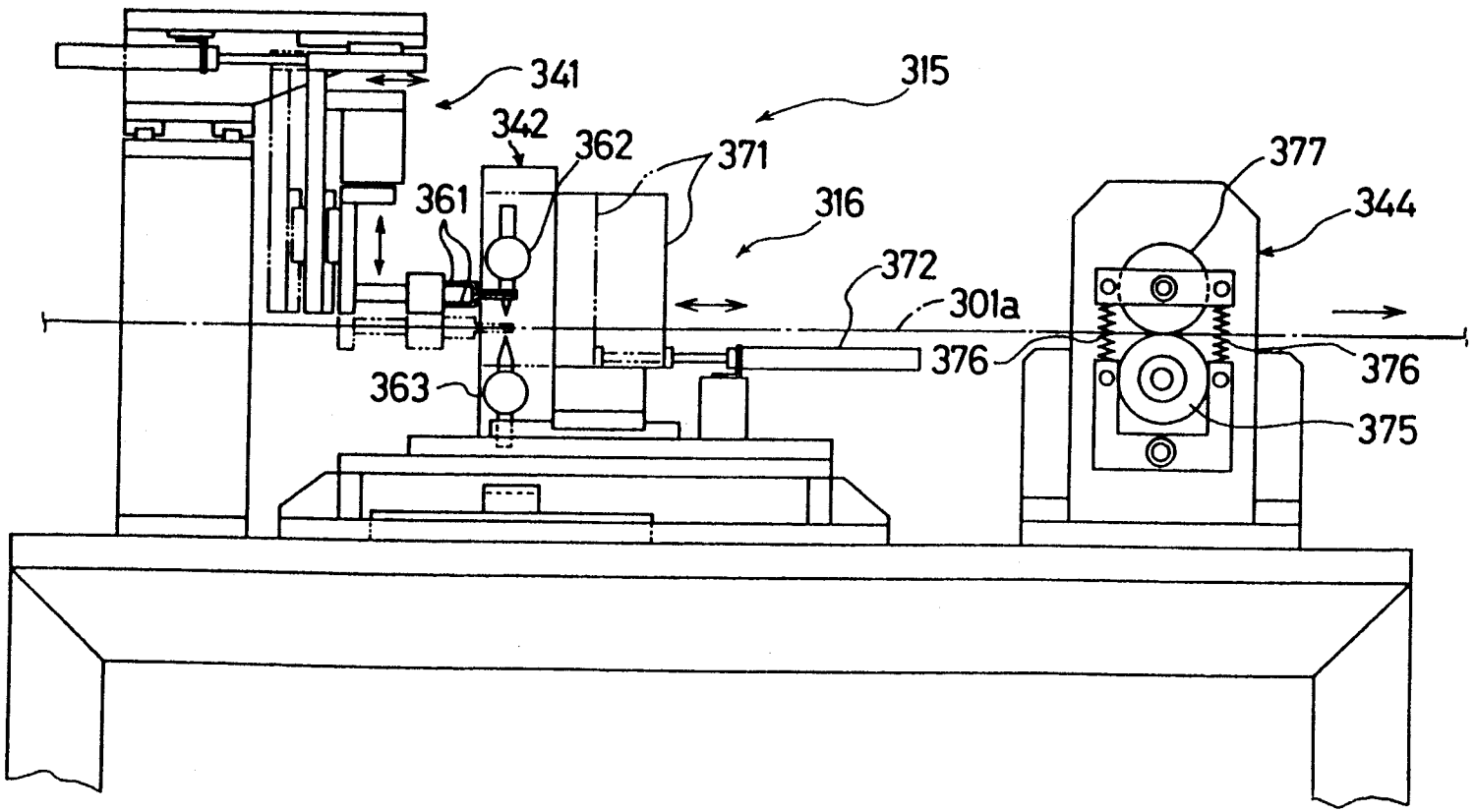
FIG. 20 is a detail side view of a lead material welding device in FIG. 14.
Figure 21:
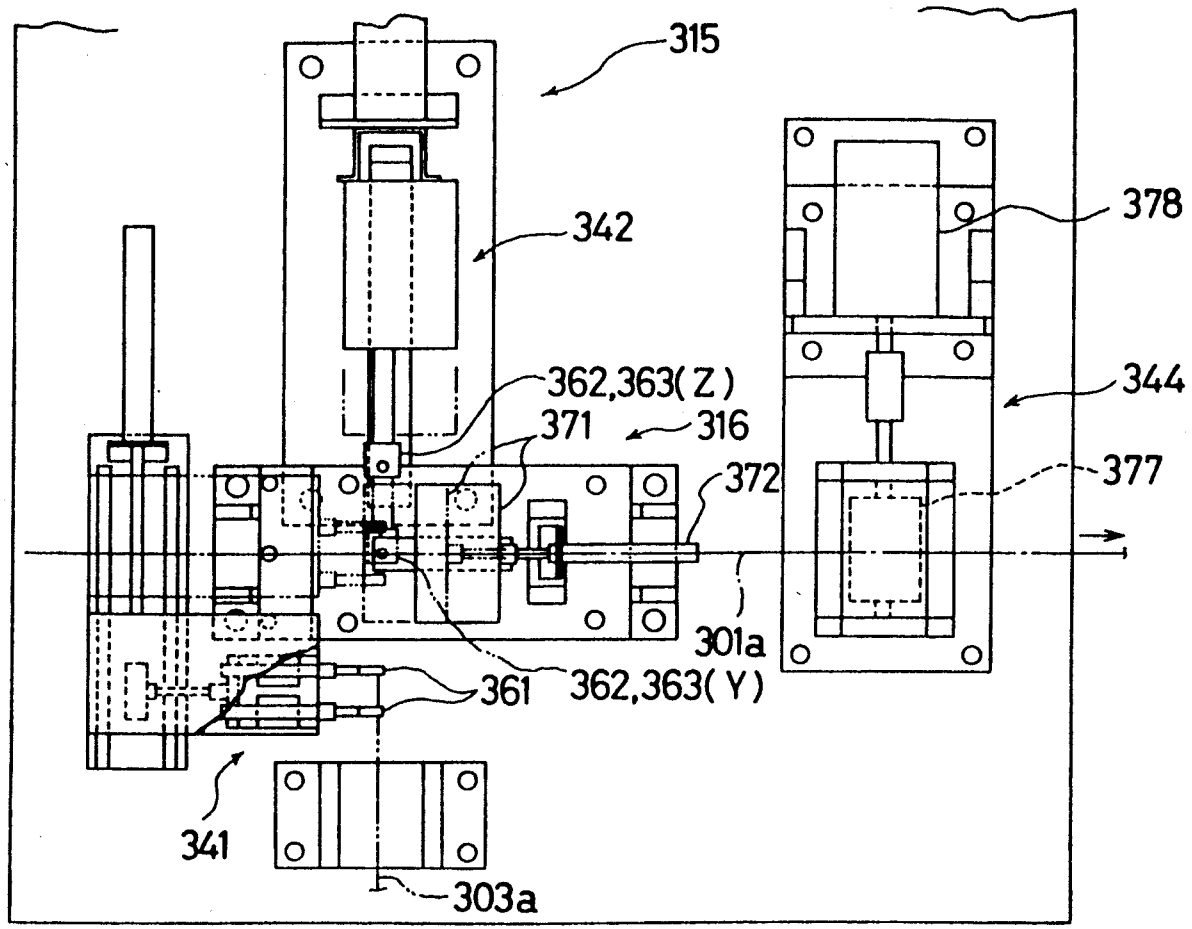
FIG. 21 is a detail plan view of the lead material welding device shown in FIG. 20.

The lead material welding device 315, as shown in FIGS. 20 and 21, comprises a lead material holding device 341, a welder 342, above mentioned lead material cutting device 316, and a feed device 344 for feeding a conductor foil 301*a*.

Figure 22:
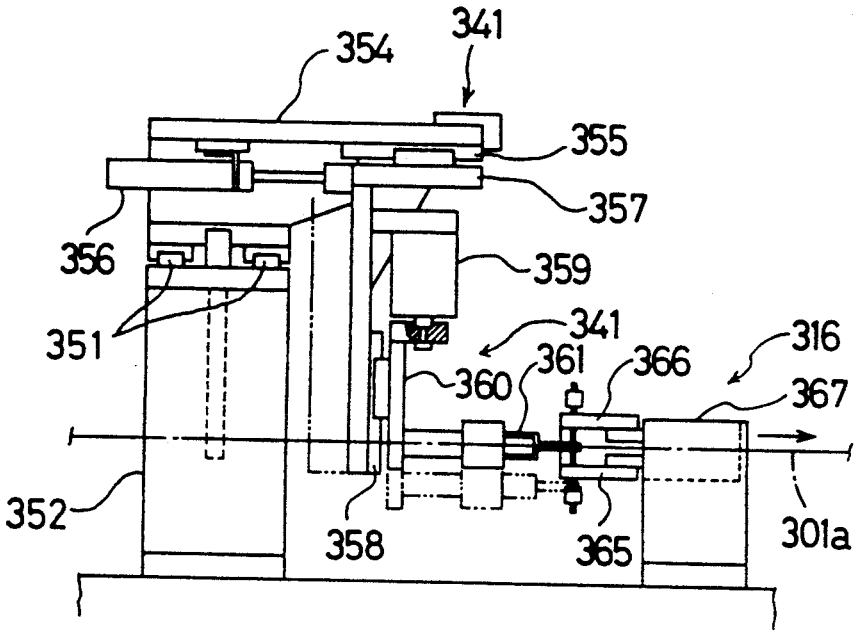
FIG. 22 is a side view of a lead material holder in a lead material cutting device shown in FIG. 20.
Figure 23:
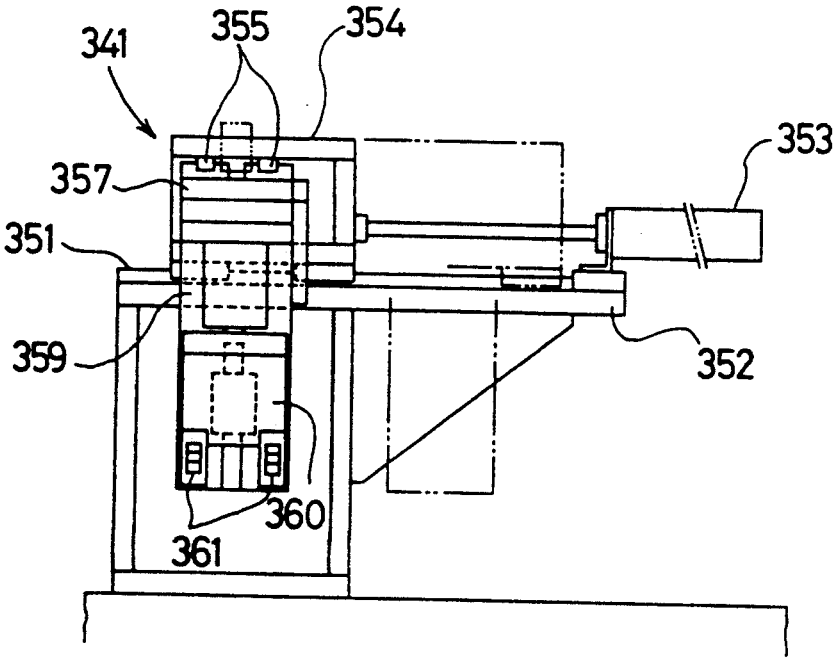
FIG. 23 is a front view of the lead material holder.
Figure 24:
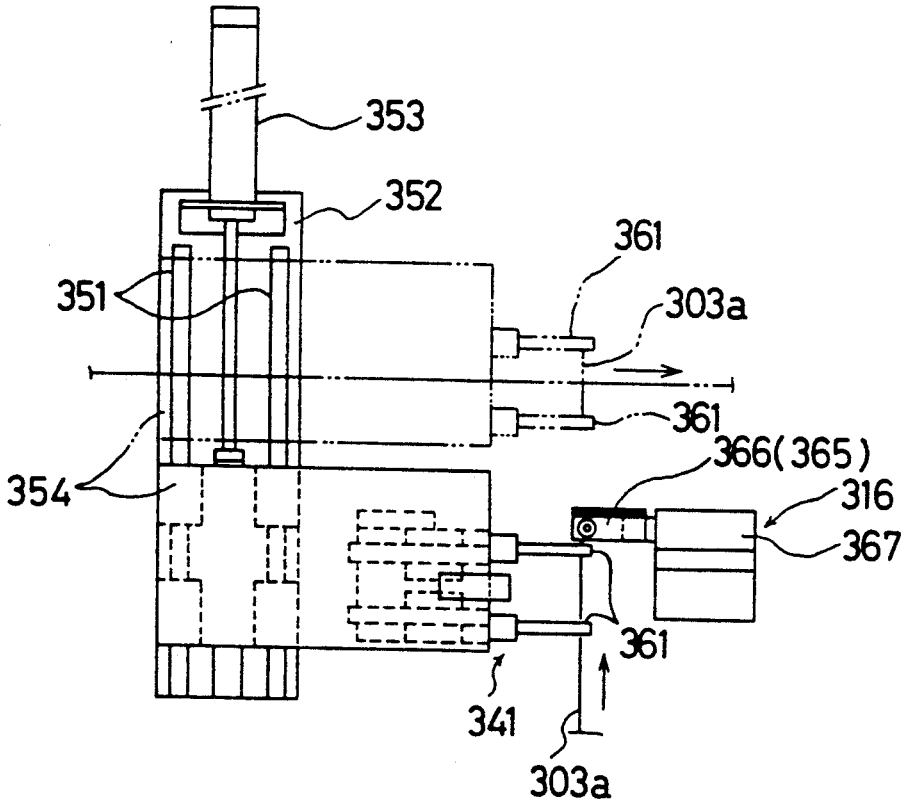
FIG. 24 is a plan view of the lead material holder.

The lead material holding device 341, as shown in FIGS. 22 to 24, comprises a frame 352 having a first horizontal guide rail 351 placed in a direction rectangular to the direction of transport of conductor foil 301*a*; a first movable member 354 guided along the first horizontal guide rail 351 and connected to a cylinder device 353 for reciprocating movement between specified locations; a second movable member 357 guided by a second horizontal guide rail 355 mounted to the first movable member 354 and along the path of transport of conductor foil 301*a*, the second movable member 357 being adapted to be moved by a cylinder device 356; an up-and-down movable member 360 guided along a vertical guide rail 358 mounted to the second movable member 357 and connected to a cylinder device 359 for vertical movement within a predetermined height range; and a pair of lead material holders 361 mounted at opposite sides to the up-and-down movable member 360.

The welder 342, as FIGS. 20 and 21 show, includes a pair of welding heads 362, 363, upper and lower, arranged at both sides of the path of transport of conductor foil 301a and movable between a welding position Y on the transport path and a turnout position Z outside the transport path.

The lead cutting device 316 is operative to cut lead material 303a held by the lead material holding device 341 to a suitable length, and as FIGS. 22 and 24 show, comprises a lower arm member 365 having a lower blade, an upper arm member 366 having an upper blade, and an elevator 367 for lowering the upper arm member 366 to enable the upper and lower blades to cut lead material 303a.

Further, the lead cutting device 316, as FIGS. 20 and 21 show, includes a cutter body 371 having lower and upper blades and an elevator for moving the upper blade upward and downward to enable opposite ends of lead material 303a welded by the lead material welding device 315 to conductor foil 301a to be cut again to precise length, and a cylinder device 372 for causing the cutter body 371 to reciprocably move along the transport path. The cutter body 371 is caused to shunt by the cylinder device 372 during the transport of lead material 303a to the welding position so as not to interfere with the transport.

The feed device 344 for feeding the conductor foil 301a, as FIGS. 20 and 21 show, comprises a drive roller 375, a presser roller 377 rotatably supported at a level above the drive roller 375 and virtically movably supported through a spring element 376, and a motor 378 for driving the drive roller 375 into rotation.

When conductor foil 301a is supplied to the lead material welding device 315, lead material tape 303 is held in place by the lead material holding device 341 and is briefly cut by the lead material cutting device 316. The resulting lead material 303a is moved to a predetermined position on conductor foil 301a.

After welding head 362, 363 is moved to a predetermined welding position, lead material 303a is welded to conductor foil 301a and thus lead 303b is obtained.

Figure 25:
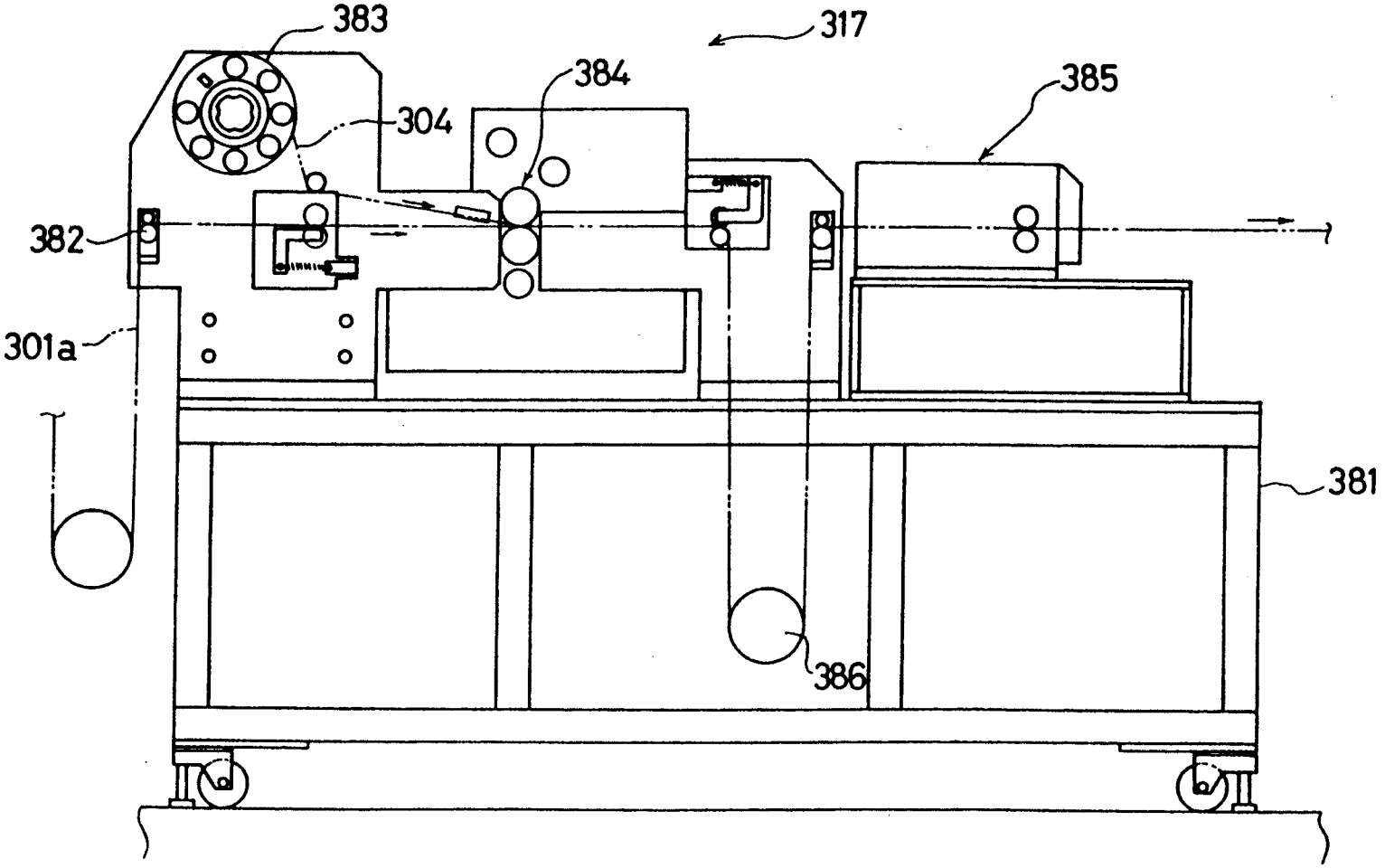
FIG. 25 is a side view of a laminating apparatus installed next to the apparatus shown in FIG. 14.

Nextly, the laminating device 317 will be described with reference to FIG. 25.

The laminating device 317 comprises a frame 381; guide rollers 382 disposed at one end side of the frame 381 for guiding conductor foil 301a; an insulating tape supply reel disposed at a position above the guide rollers 382 and having insulating tale 304 wound thereon; a pair of laminating roller devices 384, upper and lower, arranged centrally on the frame 381, a regular-size slitter 385 for cutting conductor foil 301a having insulating tape 304 mounted thereon so as to give such a number of turns as specified according to the part for which the foil is used; and a velocity regulating roller 386 disposed between the regular size slitter 385 and the laminating roller devices 384.

Nextly, the manufacturing procedure for obtaining conductor foil of the desired pattern will be briefly described.

Conductor foil tape 301 having rectangular holes 302 formed by the press device 312 shown in FIG. 14 is cut by the conductor foil cutting device 313 so that opposite side edge portions 301b are severed therefrom. As a result, a conductor foil 301a of a predetermined pattern is obtained. This conductor foil 301a is supplied to the lead material welding device 315. Lead material 303a supplied from the lead material supply device 314 is welded to the conductor foil 301a by the welding device 315. The welded lead material 303a is then cut to the predetermined length to form a lead 303b.

The conductor foil 301a having lead 303b formed thereon is supplied to the laminating device 317 by which insulating tape 304 is applied thereon. Thus, a predetermined conductor pattern, as shown in FIGS. 17A to 17C by way of example, is obtained.

The conductor foil 301a is then folded in manner as earlier described, whereby an LC noise filter is obtained.

Figure 26:
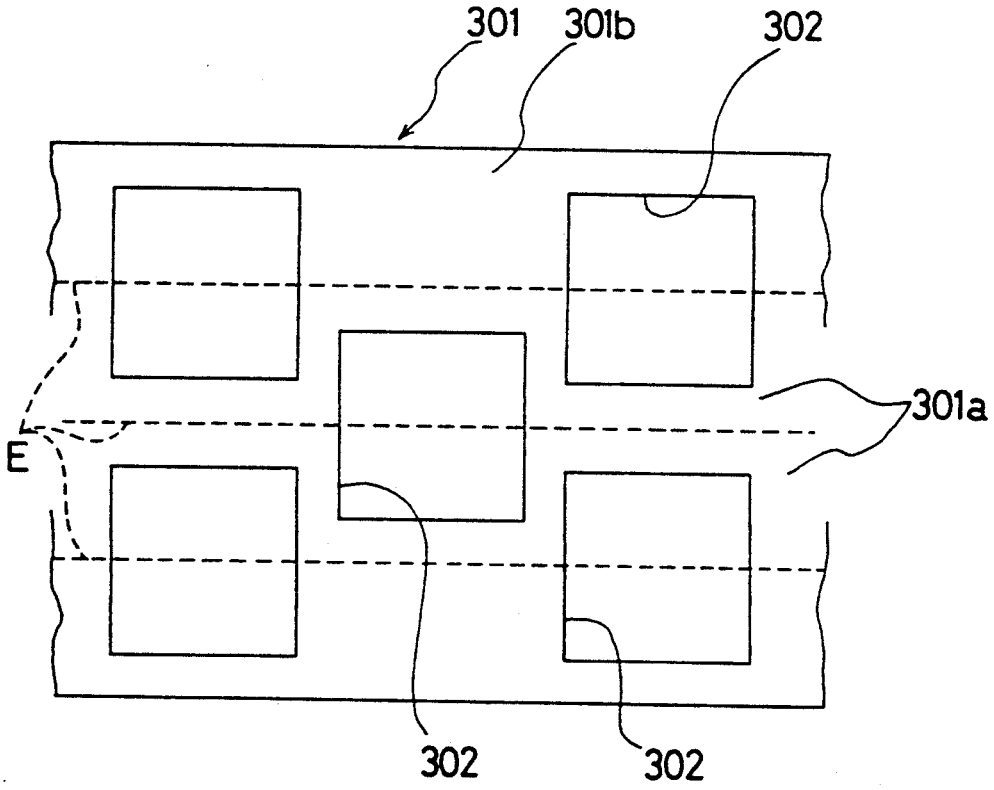
FIG. 26 is a fragmentary plan view showing another example of conductor foil tape.

In the foregoing embodiment, a length of conductor foil tape 301 is formed with two rows of rectangular holes 302 to give one sheet of conductor foil 301a. Alternatively, as FIG. 26 shows, rectangular holes 302 may be formed in three rows and, as indicated by broken lines, opposite side edge portions 301a of the conductor foil tape 301 are severed and then the remaining portion is cut along the center of the middle row of rectangular holes 302, whereby two sheets of conductor foil 301b can be obtained at one time. If desired, rectangular holes 302 may be formed in four rows or more to give three or more sheets of conductor foil 30 at one time.

Nextly, the method of manufacturing a laminated conductor film sheet comprising an insulating sheet and a conductor foil of a predetermined pattern formed thereon, for use as a material in making such a folded L C noise filter as mentioned herein, will be explained with reference to FIGS. 27 to 30.

First, a conductor foil 402, such as a copper foil, is applied on both sides of an insulating sheet (which may also be called insulating film) 401 of a specified size made of polyethylene terephthalate or the like.

Then, a resist film is deposited on the surface of the conductor foil applied on each surface side. In this case, the resist film should be of such configuration that upper surface conductor pattern 403 and underside conductor pattern 404 can be obtained in large numbers. Conductor patterns 403, 404, as shown in FIGS. 27 and 28, are formed in plural rows, each row consisting of a series of rectangular figures, and are arranged in same phase.

Figure 27:
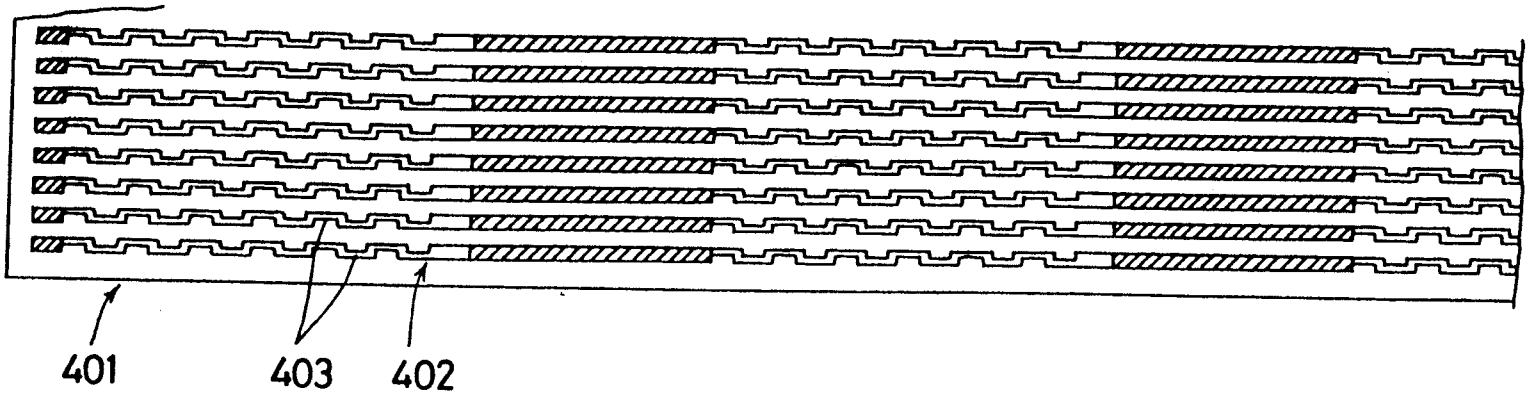
FIG. 27 is a fragmentary plan view showing the surface of an insulating sheet for explaining the method of manufacturing a conductor film laminated material according to an embodiment of the invention.
Figure 28:
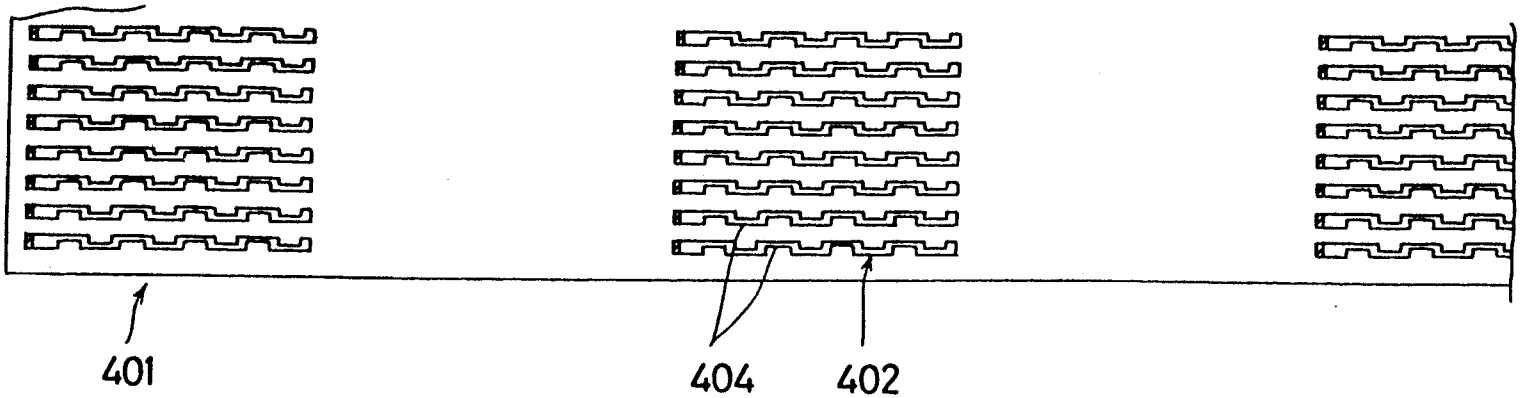
FIG. 28 is a fragmentary plan view showing the back side of the insulating sheet.

The conductor pattern 403 on the upper surface, shown in FIG. 27, serves as inductor and partly as capacitor. The conductor pattern 404 on the back side, shown in FIG. 28, serves as part of capacitor.

Subsequently, both sides of the insulating sheet 401 are subjected to chemical etching, so that conductor foil 402 other than those portions thereof which are protected by resist film are removed. Thereafter, the remaining resist film is removed, with the result that such repetitive rectangular conductor patterns 403, 403 as shown are obtained in large number at one time.

Figure 29:
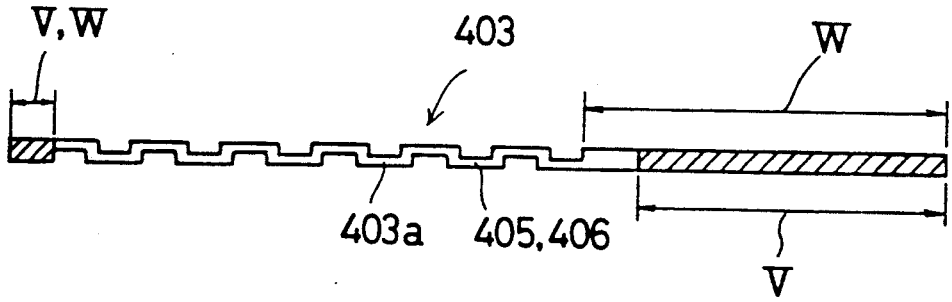
FIG. 29 is an enlarged plan view showing one example of conductor pattern in the same embodiment.
Figure 30:
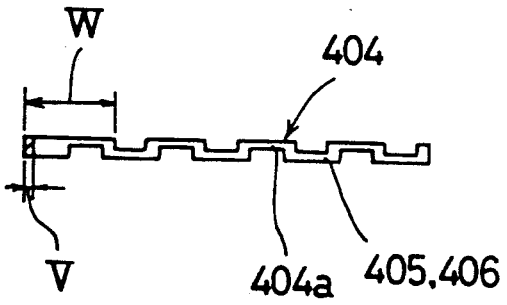
FIG. 30 is an enlarged plan view of another example of conductor pattern in the same embodiment.

Then, as shown in FIGS. 29 and 30, body portions 403a, 404a of the conductor patterns formed on both surfaces, except both end portions thereof which serve as leads, are coated with a solder resistant insulating material 405 and further with heat sensitive adhesive 406. In FIGS. 29 and 30, there are shown regions V labeled no coating allowed of solder resistant insulator 405 and regions W labeled no coating allowed of heat-sensitive adhesive 406. These non-coating regions V, W may vary according to the method of folding conductor film laminated sheet which is employed at the time of noise filter manufacturing. It is understood, therefore, that such specific regions shown in FIGS. 29 and 30 should be taken as mere examples.

In the above described manner, it is possible to make components of an L C noise filter in large number at one time and yet with a high degree of accuracy.

Since insulating sheet 401 is coated on both surfaces with insulating agent 405 and heat-sensitive adhesive 406, after being folded, the insulating sheet can be readily shaped into a noise filter by heat press or otherwise.

Since insulating sheet 401 has conductor patterns 403, 404 formed integrally with opposite surfaces thereof, conductor patterns 403, 404 are prevented from becoming positionally offset relative to each other when the sheet is folded.

Since conductor pattern 403, 404 is formed in plural rows, it is possible to easily obtain a multichannel type L C noise filter in which a plurality of L C noise filters are integrally arranged in parallel, by suitably selecting locations for cutting after folding.

In connection with the foregoing embodiment, method of making components of an L C noise filter is explained. A similar method is also applicable for purposes of making components of, for example, a condenser.

In the above described embodiment, conductor foil 402 is placed on both surfaces of insulating sheet 401. If desired, however, conductor film may be formed by coating of a conductor material.

In the foregoing embodiment, solder resistant insulating agent 405 and heat-sensitive adhesive 406 are separately coated. Alternatively, for example, an insulating material consisting of a mixture of solder resistant insulating material 405 and heat-sensitive agent 406 may be applied.

What is claimed is:

1. An apparatus for folding a sheet-form material in a zigzag fashion comprising:

a frame, a lower guide member and an upper guide member which are disposed in opposed relation in the frame and between which is placed said sheet-form material, means for holding one end of the sheet-form material placed between said lower and upper guide members, means for pulling the other end of said sheet-form material, a plurality of lower up-and-down movable members arranged at predetermined intervals on said lower guide member, a plurality of upper up-and-down movable members arranged at predetermined intervals and at positions alternate with said lower up-and-down movable members, a first fold imparting member disposed at an upper end portion of each lower up-and-down movable member for giving folds to said sheet-form material, a second fold imparting member disposed at a lower end portion of each upper up-and-down movable member for giving folds to said sheet-form material, means for urging said upper and lower up-and-down movable members in a direction away from each other, and means for moving said upper and lower up-and-down movable members toward each other against biasing force of said urging means, one after another from one end side of said upper and lower guide members and toward the other end side.

2. An apparatus for manufacturing a surface-mount type electronic part through the process of folding a sheet-form material comprised of an insulating sheet having a conductor of a predetermined shape formed on one side or both sides thereof by using a folding apparatus as set forth in claim 1, comprising:

means for compacting the sheet-form material folded by said folding apparatus by pressing one end side portion of the sheet-form material toward the other end side portion thereof, said compacting means comprising:

a storing member having a storing recess formed therein for housing the sheet-form material folded by said folding apparatus, and means for pressing one end side portion of the sheet-form material held in the storing recess of said storing member toward the other end side portion.

3. An apparatus for folding a sheet-form material in a zigzag fashion comprising:

a frame, lower cylinders provided in plurality in the frame at predetermined intervals and made upwardly extensible, upper cylinders provided in plurality in said frame at predetermined intervals and made downwardly extensible, said upper cylinders being adapted to provide a space for allowing said sheet-form material to be placed between the upper cylinders and said lower cylinders, means for holding one end of the sheet-form material placed between said lower cylinders and said upper cylinders, means for pulling the other end of said sheet-form material, a first fold imparting member disposed at the upper end of an expansion rod of each lower cylinder for imparting folds to said sheet-form material, a second fold imparting member disposed at the lower end of an expansion rod of each upper cylinder for imparting folds to said sheet-form material, and means for actuating said lower and upper cylinders to start expansion movement sequentially from lower and upper cylinders positioned at one end side of said frame and toward lower and upper cylinders positioned at the other end of the frame.

4. An apparatus for manufacturing a surface-mount type electronic part through the process of folding a sheet-form material comprised of an insulating sheet having a conductor of a predetermined shape formed on one side or both sides thereof by using a folding apparatus as set forth in claim 3, comprising:

means for compacting the sheet-form material folded by said folding apparatus by pressing one end side portion of the sheet-form material toward the other end side portion thereof, said compacting means comprising:

a storing member having a storing recess formed therein for housing the sheet-form material folded by said folding apparatus, and means for pressing one end side portion of the sheet-form material held in the storing recess of said storing member toward the other end side portion.

5. A method of manufacturing a conductor foil of a rectangular toothed-edge configuration, which comprises:

forming rectangular holes in a conductor foil tape at a predetermined pitch and at different positions alternate widthwise of the tape, and in plural rows, and then cutting the conductor foil tape along the length thereof and at positions containing portions of respective rows of rectangular holes.

* * * * *